US009222742B2

(12) United States Patent
Steuwer et al.

(10) Patent No.: US 9,222,742 B2
(45) Date of Patent: Dec. 29, 2015

(54) SELF-LOCKING FIREARM SAFETY DEVICE AND PROCESS FOR SECURING A FIREARM

(75) Inventors: Dirk Steuwer, München (DE); Johannes Aberl, Moosinning (DE); Tobias Naber, München (DE)

(73) Assignee: Armatix GmbH, Unterfohring (DE)

( * ) Notice: Subject to any disclaimer, the term of this patent is extended or adjusted under 35 U.S.C. 154(b) by 737 days.

(21) Appl. No.: 12/921,665

(22) PCT Filed: Mar. 11, 2009

(86) PCT No.: PCT/EP2009/001732

§ 371 (c)(1), (2), (4) Date: Feb. 14, 2011

(87) PCT Pub. No.: WO2009/127301

PCT Pub. Date: Oct. 22, 2009

(65) Prior Publication Data

US 2011/0119890 A1 May 26, 2011

(30) Foreign Application Priority Data

Mar. 12, 2008 (EP) ..... 08004553

(51) Int. Cl.

| | |
|---|---|
| ***F41A 17/44*** | (2006.01) |
| ***B23P 11/00*** | (2006.01) |
| ***B23P 19/00*** | (2006.01) |

(52) U.S. Cl.

CPC ..... *F41A 17/44* (2013.01); *Y10T 29/49815* (2015.01); *Y10T 29/49826* (2015.01)

(58) Field of Classification Search

CPC ..... F41A 17/44; Y10T 29/49815; Y10T 29/49826

USPC ..... 42/70.11

See application file for complete search history.

(56) References Cited

U.S. PATENT DOCUMENTS 2,530,560 A * 11/1950 Young ..... 42/70.01
4,672,762 A * 6/1987 Nilsson ..... 42/70.01

(Continued)

FOREIGN PATENT DOCUMENTS

DE 3836361 5/1990
DE 19841107 7/1999

(Continued)

OTHER PUBLICATIONS

International Search Report for PCT/EP2009/001732 filed Mar. 11, 2009; 4 pages.

(Continued)

*Primary Examiner* — Bret Hayes

(74) *Attorney, Agent, or Firm* — Westman, Champlin & Koehler, P.A.

(57) ABSTRACT

The present invention relates to a locking element to be insertable into a cartridge chamber of a firearm, the locking element having a proximal end and a distal end. The locking element includes an outer sleeve with a movable operating element provided therein, wherein the sleeve includes a (first) diameter such that the sleeve is snugly insertable into the cartridge chamber from the cartridge chamber side, but the diameter being larger than the diameter of the barrel of the firearm. The at least one blocking element is pressed against the wall of the cartridge chamber if external pressure is applied from the distal end to the operating element.

39 Claims, 11 Drawing Sheets

(56) References Cited

U.S. PATENT DOCUMENTS

| | | | | |
|---|---|---|---|---|
| 5,054,223 | A * | 10/1991 | Lee | 42/70.11 |
| 5,115,589 | A * | 5/1992 | Shuker | 42/70.11 |
| 5,138,785 | A * | 8/1992 | Paterson | 42/66 |
| 5,860,241 | A | 1/1999 | Waters | 42/70.11 |
| 5,890,310 | A * | 4/1999 | Bogstrom | 42/70.11 |
| 5,950,344 | A | 9/1999 | Ross | 42/70.11 |
| 6,308,450 | B1 * | 10/2001 | Ireblad et al. | 42/70.11 |
| 6,314,777 | B1 * | 11/2001 | Allen | 42/70.11 |
| 6,502,344 | B1 * | 1/2003 | Zeh et al. | 42/70.11 |
| 6,560,910 | B1 * | 5/2003 | McLaren | 42/70.11 |
| 6,662,484 | B1 * | 12/2003 | Andree et al. | 42/70.11 |
| 2002/0170222 | A1 | 11/2002 | Alanko | 42/70.11 |
| 2002/0170223 | A1 * | 11/2002 | Beretta | 42/70.11 |
| 2003/0089016 | A1 * | 5/2003 | Hyytinen | 42/70.11 |
| 2004/0025394 | A1 * | 2/2004 | Young | 42/70.11 |
| 2005/0115131 | A1 * | 6/2005 | Markbreit et al. | 42/70.11 |
| 2006/0101696 | A1 * | 5/2006 | Ligard | 42/70.11 |
| 2006/0288624 | A1 * | 12/2006 | Ha | 42/70.11 |
| 2007/0079540 | A1 * | 4/2007 | Giebel et al. | 42/70.11 |
| 2007/0089598 | A1 * | 4/2007 | Courty | 89/196 |
| 2008/0086927 | A1 * | 4/2008 | Wajdic et al. | 42/70.11 |

FOREIGN PATENT DOCUMENTS

| | | |
|---|---|---|
| DE | 202006003042 | 6/2006 |
| DE | 202007007712 | 10/2007 |
| EP | 1767892 | 3/2007 |
| WO | WO90/04148 | 4/1990 |
| WO | WO91/01476 | 2/1991 |
| WO | WO2004008058 | 1/2004 |

OTHER PUBLICATIONS

Written Opinion of the International Searching Authority for PCT/EP2009/001732 filed Mar. 11, 2009; 9 pages.

* cited by examiner

SELF-LOCKING FIREARM SAFETY DEVICE AND PROCESS FOR SECURING A FIREARM

CROSS-REFERENCE TO RELATED APPLICATION

This Application is a Section 371 National Stage Application of International Application No. PCT/EP2009/001732, filed 11 Mar. 2009 and published as WO2009/127301 on 22 Oct. 2009, in English, the contents of which are hereby incorporated by reference in their entirety.

The present invention relates to a locking device and a process for locking a cartridge chamber and optionally a barrel of a firearm, in particular of a long gun. The locking device according to the present invention is usually provided in the cartridge chamber for locking the cartridge chamber and the barrel of a long gun and makes it impossible for the firearm to be fired.

DE 198 41 107 A1 (ProSafeArms) for example discloses a safety device wherein the cartridge magazine or cartridge chamber in revolvers is blocked. For this purpose, a safety sleeve is first inserted in the cartridge magazine via the normal loading process. Furthermore, a guide tube with a notch-bolt is inserted from the muzzle in the direction of the cartridge magazine. For blocking the cartridge magazine, the notch-bolt engages in the safety sleeve. Also, at the end of the guide tube a lock is provided which can, for example, be a combination lock, a deadbolt lock or a padlock, and which prevents an unauthorized removal of the notch-bolt and the safety sleeve from the outside. However, such a safety device has the disadvantage that the lock can easily be broken from the outside and therefore does not offer reliable protection. Moreover, such a safety device is unfavorable for long guns which would require a very long guide tube inside the long barrel of a long gun.

Furthermore, a safety element is known from U.S. Pat. No. 5,950,344 (Omega) which is inserted in the barrel of a firearm and can expand in the barrel such that it blocks the barrel. The safety element comprises a compression shaft with a socket at one end. The compression shaft runs through a bore in an expandable portion (preferably made from rubber) and terminates in a threaded portion which engages a threaded tube. If the socket and thus the compression shaft is turned, the threaded portion bores into the threaded tube and causes the expandable portion to be compressed and expanded. However, such a safety element wherein the expandable portion is made for example of a rubber material has the disadvantage that it can easily be removed and thus offers no reliable protection. Furthermore, the handling of the safety element is complicated, requiring several actions to place the safety element into the barrel and to remove it therefrom.

Furthermore, DE 38 36 361 A1 discloses a device for securing firearms with tip-up barrels. A rod is provided at its front end with a hemispherical seal of having the same diameter as the rod, which can be inserted into the gun barrel and then locked, e.g., with a padlock. The back end of the rod on the other hand is provided with a lock in the form of a collar-type seal, wherein the collar-type is larger than the diameter of the firearm barrel. The front end of the rod is inserted into a tip-up firearm barrel until the collar-type seal is flush with the barrel, while the other end is locked with a lock so that the rod cannot be pulled out of the barrel. Such a design involves the disadvantage that the lock can easily be broken or the gun barrel simply sawed off. Thus, the device does not offer a reliable protection against unauthorized users. Furthermore, it can only be used in guns with tip-up barrels.

U.S. Pat. No. 5,860,241 relates to an electronic gun lock for a firearm which includes an electronic lock enclosure, a locking shaft member, and an optional locking shell. The locking shell, if used, is disposed within a bullet chamber of the firearm, and is adapted to fit both the firearm's bullet chamber and the locking shaft member. The locking shaft member extends through the bore of the barrel and includes an axially moveable elongated locking rod which is moveable between an unlocked position where the locking rod is slidable with respect to the locking shell (or bullet chamber if no locking shell is used) and a locked position where the locking rod is restrained against axial movement with respect to the locking shell (or bullet chamber). Again, such a device is unfavorable for long guns which would require a very long locking shaft member for extending through the bore of the long barrel of a long gun.

WO 2004/008058 A1 also discloses a safety device for firearms which can be introduced into the barrel of a firearm. For this purpose, a clamping means with expanding clamping jaws is operated from the outside by twisting an armor connected to an expanding thread. According to an example, the safety device comprises a locking portion which is clampable to the barrel and detachable therefrom. The locking portion enables positive and frictional engagement with the inside of the firearm barrel. Furthermore, a deactivation element is provided with an additional actuator. The safety device can only be unlocked when the deactivation element releases the expanding thread so that it can be twisted. In one embodiment, the armor can also be connected with a coupling means which rotates the armor such that the safety device is for example unlocked when the actuator releases the expanding thread via the deactivation element.

It is the object of the present invention to provide a locking element, an operating unit for operating the locking element and a process for reliably locking a firearm, preferably a long gun, which in addition can be handled easily and quickly.

This object is achieved by a locking element according to claim 1. Additional preferred embodiments are described in the dependent claims.

The locking element of the present invention has the advantage that it can reliably lock the cartridge chamber and/or the barrel of a firearm, in particular of a long gun in both directions, i.e., from the muzzle side and the cartridge chamber side. Furthermore, the locking element can easily and quickly be mounted in and removed from the cartridge side, namely by means of an operating unit which preferably operates the locking element preferably via an electronic device and an actuator. Moreover, according to preferred embodiments of the present invention, the locking element may be inserted into the cartridge chamber without using an additional operating element, e.g., by simply inserting the locking element into the cartridge chamber by hand. According to this embodiment, the operating element is merely used for removing the locking element. However, as will be discussed later in detail, it may be preferred to insert the locking element according to the present invention by means of the operating element which may provide a better "prelocking". The locking element according to the present invention has the further advantage that it is small, which reduces the attackable surface of the device.

A further advantage of the present invention is provided by the outer dimensions of the locking element which enables an easy insertion of the locking element into the cartridge chamber and optionally partly into the barrel (of a long gun) from the cartridge chamber side. The outer dimensions of the locking element are preferably adapted to the dimensions and shape of (a long gun) cartridge chamber such that the locking element snugly fits into the cartridge chamber but is prevented in advancing into the barrel. In other words, the blocking in the direction cartridge chamber-muzzle is achieved by the geometrical outer dimensions of the locking element. In particular, the locking element preferably comprises a substantially cylindrical shape, preferably similar to a cartridge, with a diameter that allows a snug fit inside the cartridge chamber. Since the diameter of the cartridge chamber is larger than the diameter of the barrel, and the diameter of the locking element is larger than the barrel (but slightly smaller than the cartridge chamber), the geometrical dimensions merely allow an insertion until the locking element abuts at the junction between the cartridge chamber and the barrel.

Since the adapted outer dimensions of the locking element easily achieve the blocking or locking of the cartridge chamber from one direction, i.e. the direction from the cartridge chamber side to the muzzle side, it is advantageous that only for the other direction, i.e., the direction from the muzzle side to the cartridge chamber side, a locking mechanism must be provided.

In particular, the present invention relates to a locking element to be insertable into a cartridge chamber of a firearm or weapon, wherein said locking element is provided with a proximal end and a distal end. The locking element comprises an outer sleeve or casing with a movable operating element provided therein. The sleeve comprises a diameter such that the locking element is snugly insertable into the cartridge chamber from the cartridge chamber side, and preferably snugly fits in the cartridge chamber, e.g. the diameter of the sleeve is slightly smaller than the cartridge chamber. The diameter of the sleeve is larger than the diameter of the barrel of the firearm. The operating element is formed and provided such that when the locking element is inserted with the distal end first into the cartridge chamber the operating element may move within the sleeve to the distal direction, in particular when an "inserting force" is applied at a connector support which is connected with the operating element. Such a relative movement of the operating element within the sleeve preferably causes the at least one blocking element to move in a retraced state.

The locking element of the present invention provides a locking mechanism, wherein the operating element is preferably formed and provided such that when the operating element is moved within the sleeve to the direction of the proximal end, the operating element causes the at least one blocking element to be urged radially outwardly and pressed against the wall of the cartridge chamber thus blocking the cartridge chamber. The locking element of the present invention preferably provides a self-locking mechanism wherein the at least one blocking element is pressed further against the wall of the cartridge chamber if external pressure is applied from the distal end to the operating element. The locking element according to the present invention further comprises preferably an actuator for unlocking the locking element, wherein the actuator is adapted for temporarily preventing a relative movement of the operating element in the proximal direction.

The actuator is preferably adapted for temporarily fixing the position between the operating element and the outer sleeve. In other words, for unlocking the locking element, i.e., for maintaining the blocking elements in the retracted position, it is preferred that the relative position between the operating element and the sleeve is temporarily fixed as long as the actuator is activated. However, it is also possible that the actuator comprises at least one or a plurality of stable states, e.g., one stable state in the unlocked position which can be maintained without energizing the actuator. In other words, the actuator may be activated to switch to said stable state which blocks or temporarily fixes the operating element relative to the sleeve. When the actuator is energized again, the actuator my release said stable state such that the sleeve is not fixed to the operating element, i.e., the operating element is movable within the sleeve.

The actuator may be operated via an electronic device. The electronic device is preferably located within the sleeve.

The operating element is preferably constructed such that the at least one blocking element moves into a position in which said at least one blocking element is retracted and not pressed against the wall of the cartridge chamber when said operating element is moved in the distal direction relative to the sleeve and the blocking elements remain preferably in the retracted position when said operating element is prevented from moving back in the proximal direction.

It is further preferred that the operating element projects partly beyond the sleeve at the distal end such that it is located in the barrel when the locking element is inside the cartridge chamber. This projection prevents that the sleeve is accessible, e.g., by manipulators, from the muzzle side when the locking element is locked in the cartridge chamber.

The operating element comprises preferably a conical portion for urging the at least one blocking element radially outwardly to the direction of the cartridge chamber. This conical portion also ensures the self-locking effect, i.e., the at least one blocking element is pressed further against the wall of the cartridge chamber if external pressure is applied from the distal end to the operating element.

The locking element according to the present invention preferably comprises a spring element for biasing or urging the operating element to the proximal direction relative to the sleeve such that the at least one blocking element is urged radially outwardly, e.g., the at lest one blocking element is pressed against the (inner wall of the) cartridge chamber when the locking element is located in the cartridge chamber.

The sleeve preferably comprises at the distal end a shoulder portion for abutting against the junction between the cartridge chamber and the barrel. It is further preferred that the form of the shoulder portion is adapted to the form of the junction between the cartridge chamber and the barrel such that the contact surface is maximized. In particular, the shoulder of the locking element comprises preferably a substantially equal conical angle (the angle of the shoulder relative to the longitudinal axis of the locking element) like the junction between the cartridge chamber and the barrel.

The sleeve preferably comprises cut-outs, openings or windows such that the at least one blocking element can extend partly beyond the sleeve and be pressed against the wall of the cartridge chamber. The blocking element preferably forms a frictional connection with the wall of the cartridge when the blocking element extends or projects from the cut-outs. It is further preferred that the cut-outs comprise a oval shape such that the blocking element may move along the longitudinal axis of the locking element.

The locking element preferably comprises a plurality of blocking elements, e.g., 2, 4, 6, 8, 10, 12 or even more. These blocking elements are preferably arranged radially symmetrically around the locking element.

It is further preferred that the at least one blocking element is spherical, preferably a ball.

It is yet further preferred that the blocking element(s) is/are made from a material which is substantially harder than the material of the cartridge chamber.

The locking element may further comprise a connector support at the proximal end. It is preferred that this connector support is movable within the sleeve and preferably linked (e.g. fixed) with the operating element. The connector support and the operating element may be fixedly linked and preferably made from one piece. The operating element is preferably provided at the distal end of the locking element and connected (preferably via at least one intermediate element) to an element at the proximal end, preferably fixedly connected to said element. According to a further preferred embodiment, the operating element is rotatably connected to the element at the proximal end, i.e., the element at the proximal end is rotatable relative to the operating element. The element at the proximal end and the operating element are preferably movable within the sleeve, i.e., movable relative to the sleeve. According to a preferred embodiment the operating element is longitudinally movable and/or rotatably movable with regard to the sleeve. Alternatively or additionally, the element at the proximal end and optionally the intermediate elements is/are longitudinally movable and/or rotatably movable with regard to the sleeve. Alternatively or additionally, the element at the proximal end is longitudinally movable and/or rotatably movable with regard to the operating element.

The element at the proximal end is preferably a connector support. Said connector support preferably comprises a connector. In particular, if the connector support and the operating element are mounted such that a relative movement between each other is possible, a manipulation attack with a rotating drill at the connector support will not transfer the torque from the connector support to the operating element.

The actuator preferably activates a temporary fixing means for temporarily preventing a relative movement of the operating element in the proximal direction.

It is further preferred that the temporary fixing means comprises e.g. a movable cage with a rolling element guide with at least one ball element to form a ball-check arrest for temporarily preventing a relative movement (within the sleeve) of the operating element in the proximal direction.

The actuator may comprise at least one first wire element and/or an electric motor and/or a magnet array wherein the magnet array preferably comprises at least one coil.

The locking element may comprises a second wire element which provides a force directed opposite to the first wire element when both wire elements are heated.

According to yet a further preferred embodiment, both wire elements preferably comprise a shape memory alloy, for example a nickel-titanium alloy, wherein upon heating, for example by means of resistance heating, the wire elements in the locking element shrink in length, with the resistance heating being activated via an electronic device.

The electronic device is preferably provided in the locking element and is preferably operated via a separate operating unit. The electronic device may also be provided in the operating unit to operate the actuator of the locking element if the operating unit is coupled to the locking element.

It is preferred that data and/or energy can be transferred between the operating unit and the locking element, wherein the data exchange can be both via wire and wireless.

The preferred wireless coupling between the locking element and the operating unit can be effected preferably via radio, in particular via inductive coupling, in the very low frequency, low frequency, medium frequency and/or high frequency band, for example in a range of 3 kHz to 30 Mhz.

The preferred wireless coupling between the locking element and the operating unit may be effected via an optical coupling and/or an electromagnetic coupling, wherein the electromagnetic coupling is preferably effected in the microwave and UHF frequency range for example from 400 MHz to 5 GHz. The data and/or energy may be transferred between the locking element and the operating unit.

According to a preferred embodiment of the present invention, the electronic device is self-sufficient, i.e. it comprises for example at least one battery, and/or is not self-sufficient or partially self-sufficient, wherein energy is provided via the operating unit for example via a wire or a cable or inductively.

The electronic device, which is preferably a subminiature electronic device, preferably carries out an authorization examination and/or unlocks the actuator and wherein the authorization examination is for example effected via a PIN code or biometric data.

The locking element is preferably mechanically and/or electrically coupled to the operating unit via a coupling unit.

The operating unit which is coupled to the coupling unit may be detached if an axial force larger than 1 N is applied, preferably larger than 2 N, yet preferably larger than 5 N and more preferably larger than 10 N.

The operating unit preferably comprises a separate data bus, for example a 1-wire data bus, which is connected to the electronic device of the locking element when the operating unit and the locking element are coupled.

The present invention also refers to an operating unit for the use in/with a locking element according to the present invention, wherein the operating element preferably comprises a coupling unit for coupling with the locking element.

The operating unit is preferably formed such that it can preferably be coupled with the locking element via a data bus from the outside and/or in a wireless manner and that it can transmit and/or receive data, wherein a wireless coupling between the operating unit and the locking element can be effected via radio in the very low frequency, low frequency, medium frequency and/or high frequency band, for example in a range of 3 kHz to 30 Mhz, and/or an inductive coupling, and/or an optical coupling and/or an electromagnetic coupling, wherein the electromagnetic coupling is preferably effected in the microwave and UHF frequency range for example from 400 MHz to 5 GHz.

It is further preferred that the operating unit can transfer data and/or energy to the locking element. The operating unit may be secured by an authentication process which is preferably effected via a PIN code and/or a radio transponder and/or biometric data which are collected by corresponding sensors.

The present invention also relates to a method or process for locking a locking element according to the present invention in a cartridge chamber of a firearm, e.g. a long gun. The process preferably comprising at least one of the following steps: (i) inserting the locking element into the cartridge chamber of the firearm from the cartridge chamber side by applying a force to the distal direction, such that the operating element is moved within the sleeve to the direction of the distal end such that the at least one blocking element (18) is in a retracted position; (ii) wherein upon reducing the force to the distal direction causes the operating element to move to the proximal direction within the sleeve and urges the blocking elements radially outwardly for blocking the locking element inside the cartridge chamber.

The present invention also relates to a method or process for unlocking and removing a locking element according to the present invention from a cartridge chamber of a firearm. The process comprises at least one of the following the steps: (i) coupling an operating unit to the locking element; (ii) applying a force at the proximal end of the locking element to the distal direction such that the operating element is moved within the sleeve to the direction of the distal end and the at least one blocking element is retracted; (iii) temporarily fixing the operating element within the sleeve by means of an actuator such that a relative movement of the operating element back to the proximal direction is prevented; and (iv) pulling the locking element from the cartridge chamber.

The present invention and the individual steps of locking and unlocking the cartridge chamber of a firearm are described in the more detail on the basis of the enclosed drawings.

FIG. 1*a* shows a schematic side view of a hand gun cartridge;

FIG. 1*b* shows a schematic side view of a rifle cartridge;

FIG. 1*c* shows a cross-sectional view of a part of a rifle cartridge chamber and a barrel with an inserted cartridge;

In principle, there are firearm barrels with and without cartridge magazines. Firearm barrels without a cartridge magazine have an essentially cylindrical structure with a continuous diameter. Furthermore, there are firearm barrels wherein the firearm barrel has a junction to the cartridge chamber (firearm barrel with cartridge magazine), i.e. a junction between the smaller diameter of the barrel and the larger diameter of the barrel in the portion of the cartridge chamber (cf. FIG. 1*c*). This junction is typically constructed as a small step in handguns and in form of a conical shoulder in long guns.

Figure 1A:
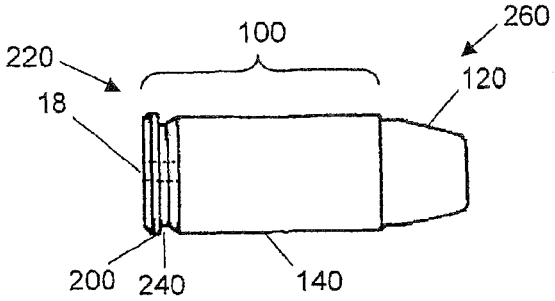

A specific difference between a handgun and long gun will be explained with regard to FIGS. 1*a* and 1*b*. FIG. 1*a* depicts a round or cartridge 100 for propelling bullet 120 as used for handguns. The cartridge 100 is constructed of casing 140 filled with propellant or powder and primer 180. Casing 140 has a rim 200 at proximal end 220 followed by extractor groove 240. The cartridge 140 of the depicted handgun cartridge comprises a cylindrical cross-section with a substantially uniform diameter along the casing length.

Figure 1B:
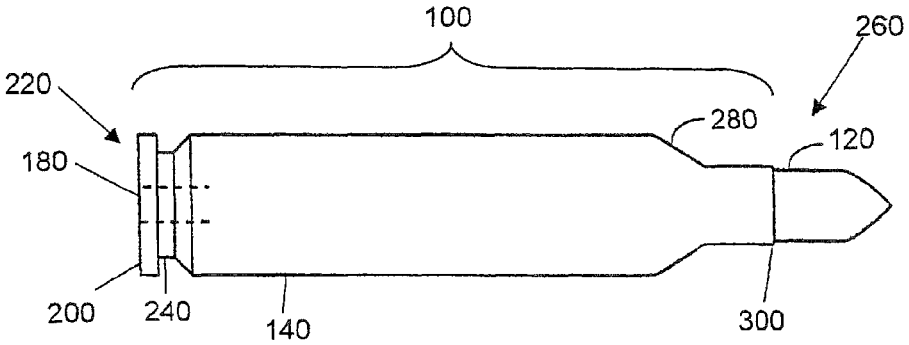

FIG. 1*b* depicts a round or cartridge 100 for a rifle or long gun. Similar parts comprise the same numbering as used in FIG. 1*a*. However, in contrast to the hand gun cartridge of FIG. 1*a*, the casing 140 of the long gun cartridge angles inward at an angle, e.g. of approximately 30°, at the distal end 260 (in the following the proximal end refers to the cartridge chamber side and distal end refers to the muzzle side) to reduce the diameter of the casing 140 to support bullet 120 at the distal end of the cartridge. The angled section is known as shoulder 280 and the angle is referred to as the shoulder angle.

Figure 1C:
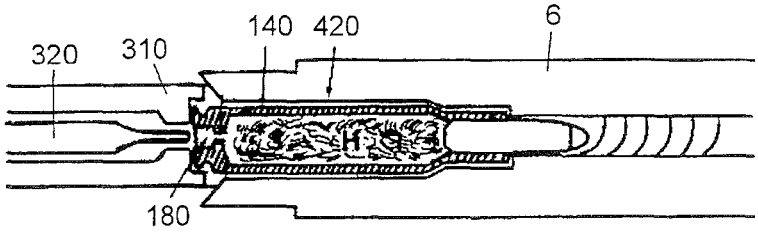

FIG. 1*c* is a cutaway drawing showing the cartridge casing 140 lying within a corresponding cartridge chamber 420 cut into the steel barrel 6. For a tight or snugly fit or an abutment of the distal end of the cartridge in the cartridge chamber and the bullet in the barrel, the barrel 6 comprises a form from the cartridge chamber to the barrel which corresponds to the form of the cartridge, i.e. the cartridge chamber comprises a larger diameter, a tapered portion (junction or shoulder) for reducing the diameter to support the bullet 120 which is centered in the barrel, wherein the barrel comprises a smaller diameter than the cartridge chamber. Such a design is typical for rifles and long guns. Completing the steel envelope enclosing the cartridge is a breeching mechanism called the bolt 310. When the firing pin 320 is released, it is spring-driven against the primer 180. When the cartridge 100 is fired, the burning powder produces gas that builds up the internal pressure, forcing the thin walls of the brass cartridge casing 140 tightly against and gripping the chamber walls.

Figure 2:
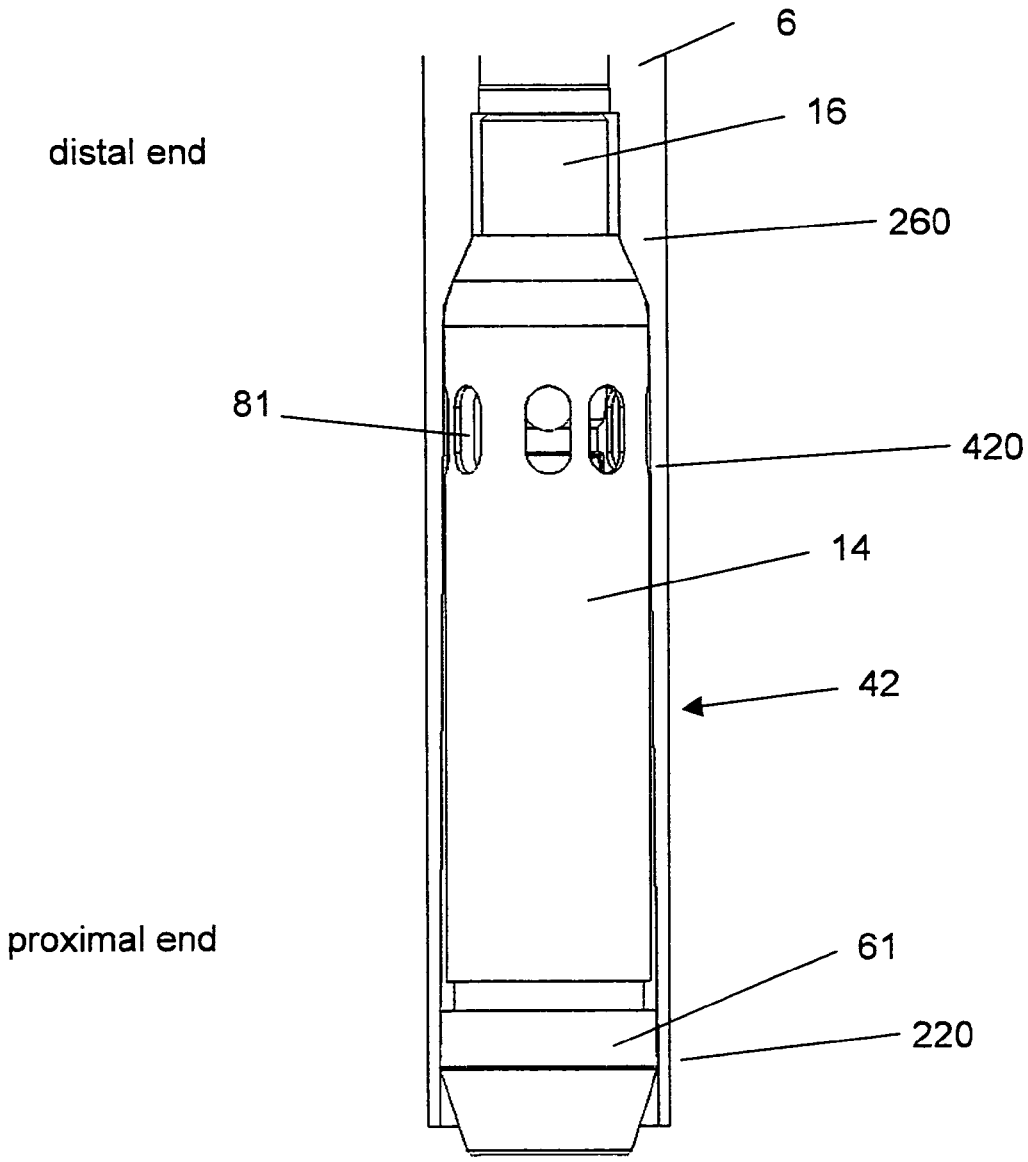
FIG. 2 shows a cross-sectional view of rifle cartridge chamber with a junction to the barrel similar to FIG. 1*c*, but with a locking element according to an embodiment of the invention inside the cartridge chamber.
Figure 3:
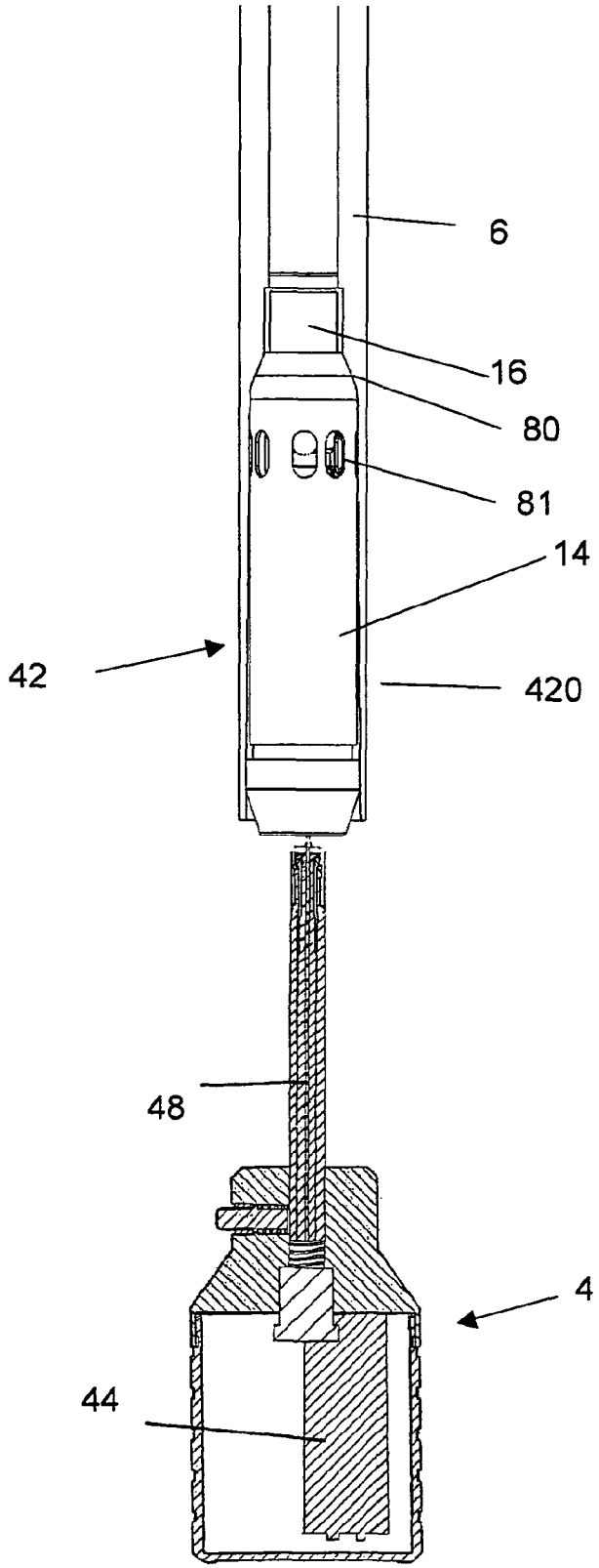
FIG. 3 shows a cross-sectional view of a part of a firearm cartridge chamber with a safety system according to an embodiment of the present invention, comprising a locking element as shown in FIG. 2 and an operating unit for connection with the locking element to lock and/or unlock the locking element in the cartridge chamber.

As can be inferred from FIGS. 2 and 3, a locking element 42 according to one embodiment of the invention has been inserted into the cartridge chamber 420 of a firearm from the cartridge chamber side. When the locking element 42 is locked inside the cartridge chamber it is impossible to load and fire the firearm. For removing the locking element 42 and re-using the firearm, an unauthorized third party would have to replace the entire barrel 6 of the firearm together with the cartridge chamber 420. It is preferred that the locking element 42 of the present invention is completely inserted into the cartridge chamber. However, according to further embodiments of the present invention, it is sufficient that only the sleeve 14 of the locking element is inside the cartridge chamber and a part of the proximal portion of the locking element, e.g. a connector support 61 may project beyond the cartridge chamber 420 as long as the sleeve 14 is not accessible from the outside.

The locking element 42 comprises a locking mechanism, which will be explained in detail in the following, as well as optionally a preferably electromechanical actuation mechanism for releasing and/or locking the locking mechanism, and optionally a miniature electronic device 9 for controlling the actuation mechanism.

Figure 4:
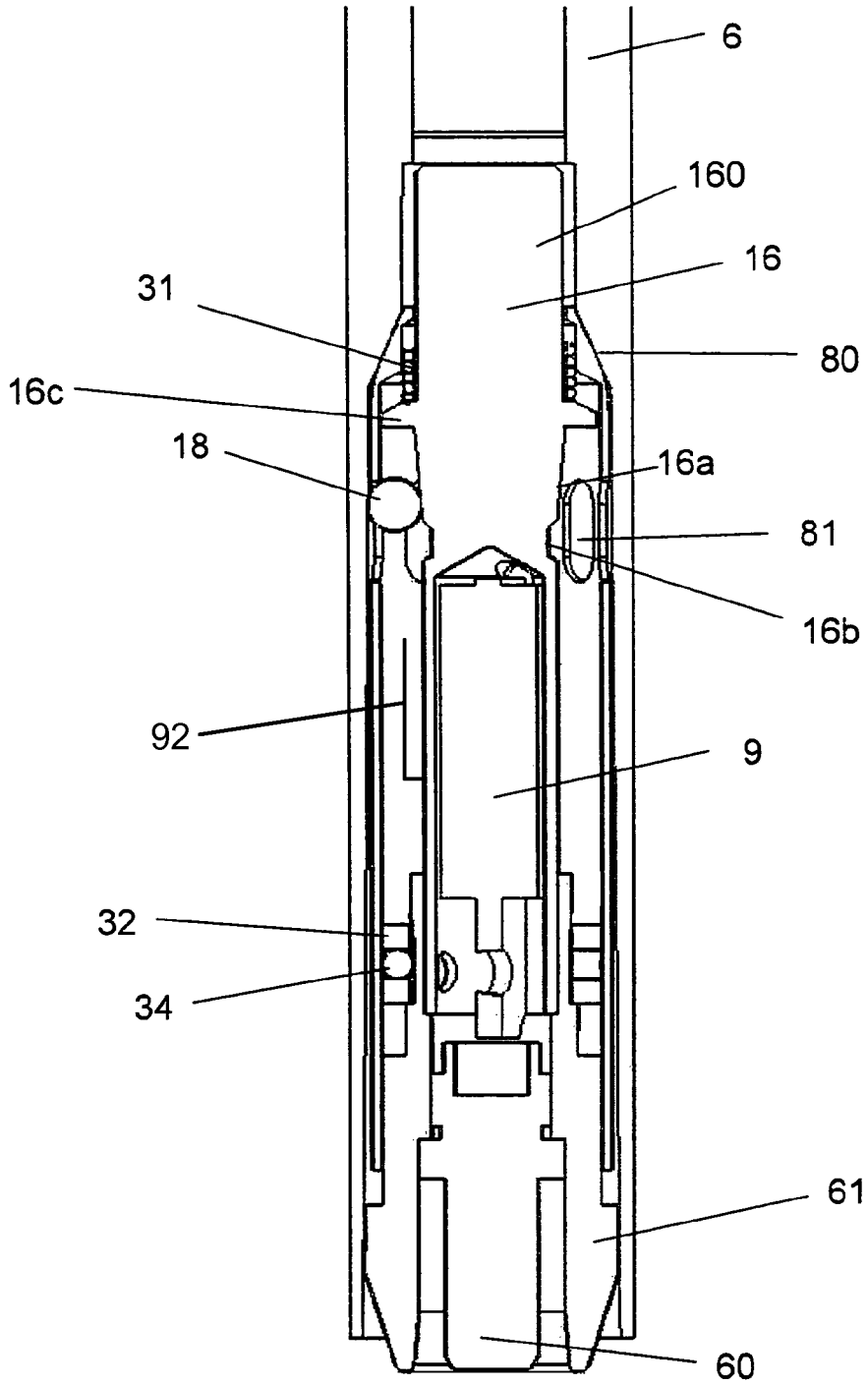
FIG. 4 shows a cutaway view of FIG. 2.
Figure 5:
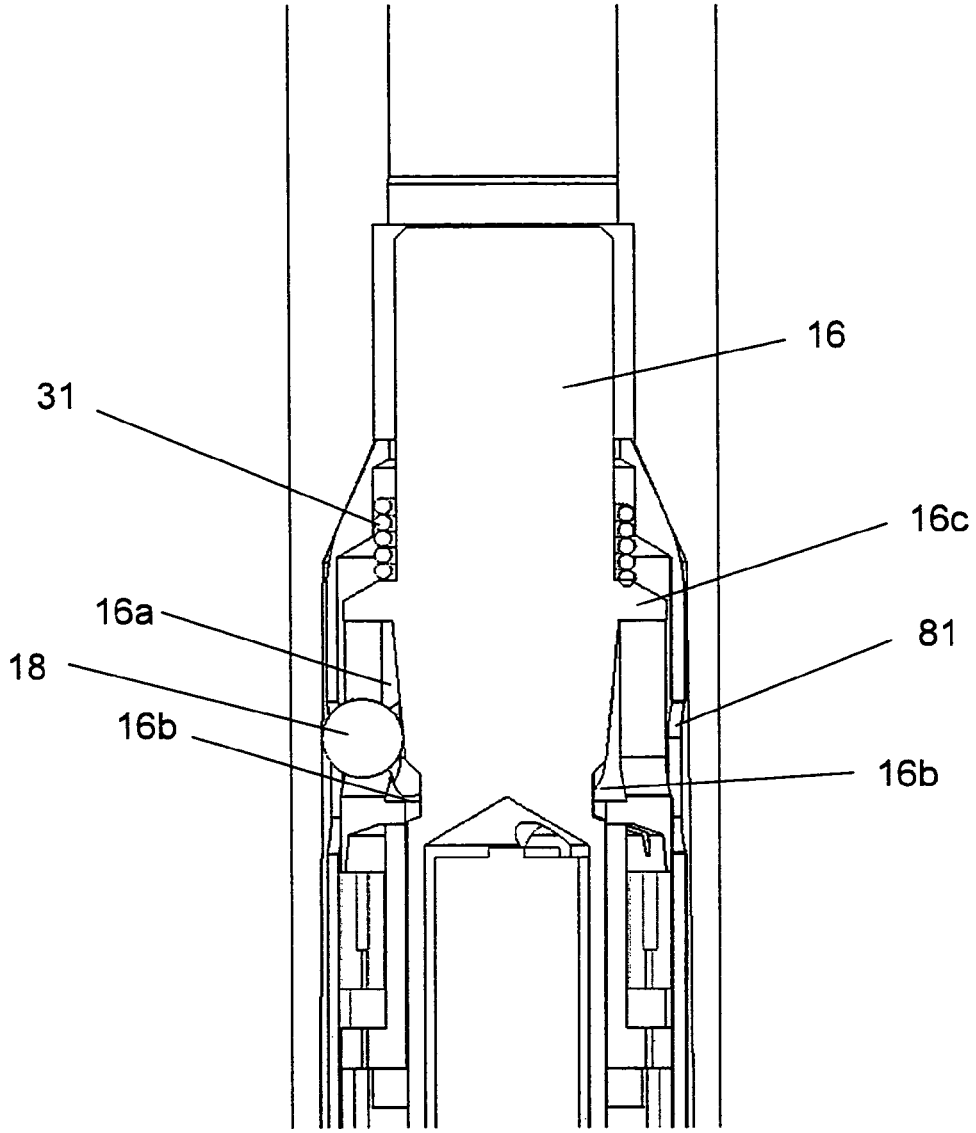
FIG. 5 shows an enlarged cutaway view of the distal end of FIG. 4 with the locking element in a locked state.
Figure 6:
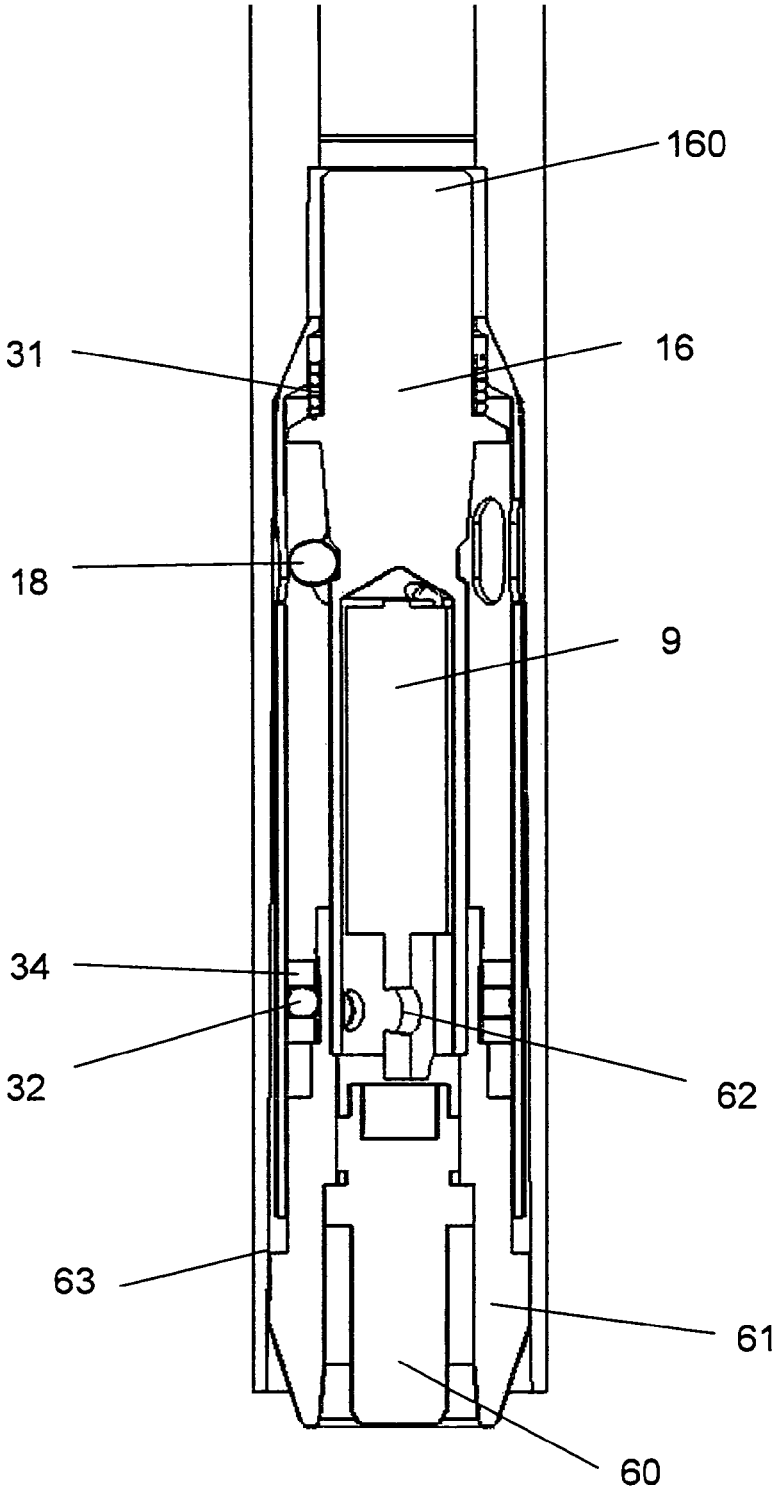
FIG. 6 shows an enlarged cutaway view similar to FIG. 4 but with a blocking element in the retracted position.

As can be inferred from FIG. 2, the locking element 42 according to the present invention comprises a casing or sleeve 14 in which an actuator, an operating element 16 and at least one blocking element 18 (not visible in FIG. 2) are provided. For symmetrical reasons, it is preferred that the locking element according to the present invention comprises a plurality of locking elements. In the following it will be referred to a plurality of locking elements although it would be also possible to provide only one blocking element. As shown in FIGS. 4, 5 and 6, the blocking elements 18 are preferably constructed as rolling elements, in particular balls. However, other forms are also possible, e.g. "cylinders" with an arcuate surface along the longitudinal axis of the cylinder like in a roller bearing. The arcuate cylinders provide a larger contact surface in comparison with ball elements which provide a point connection to the inner surface of the cartridge chamber. Preferably, the plurality of blocking or rolling elements is axially symmetrically distributed around the center axis of the sleeve 14. The locking element of the present invention comprises preferably 6, 8, 12 or even more blocking elements. There are cut-outs or windows 81 provided in the sleeve 14, preferably one cut-out or window for each blocking element such that the blocking elements are allowed to project beyond the cut-out and be pressed against the inner cartridge chamber wall. The cut-outs 81 are preferably large enough that at least a portion of the blocking element may project beyond the cut-out. However, it is further preferred that the cut-outs are smaller than the diameter of the blocking element (ball) such that the ball will not be lost.

A locking element inside the cartridge chamber and/or the barrel of the firearm should provide a blocking mechanism which secures the locking device with regard to two main manipulation directions, namely applied forces from the muzzle side and forces from the cartridge chamber side. The locking element of the present invention is designed that it can be inserted from the cartridge side into the cartridge chamber. The sleeve 14 of the locking element 42 comprises outer dimensions such that the sleeve can be inserted snuggly fitting into the cartridge chamber, i.e., the sleeve 14 is substantially cylindrical and comprises a diameter smaller than the diameter of the cartridge chamber 420, preferably only slightly smaller than the diameter of the cartridge chamber such that already a small radial projection or extension of the blocking elements 18 beyond the sleeve 18 provides a locking of the locking element 42. Since the diameter of the cartridge chamber is larger than the diameter of the barrel, it is not possible to urge the locking element 42 from the cartridge chamber through the barrel 6. In other words, the one of the two main manipulation directions is secured or locked by adapting the outer dimensions to the cartridge chamber. The outer dimensions of the locking element 42 are preferably provided in a form-fitting connection with the cartridge chamber 420 and preferably with the junction (shoulder) between the cartridge chamber and the barrel.

The junction between the cartridge chamber and the firearm barrel can be of any desired shape. As is shown in a simplified manner, e.g., in FIGS. 2 and 4, the junction can be conical. However, the present invention is not limited to conical junctions and may be also adapted for junctions which have the shape of a perpendicular edge, curved or graded shapes. Moreover, depending on the conical angle, the present locking element may comprise further means preventing the locking element from being permanently blocked or jammed within the cartridge chamber which could happen in case of shot guns with a flat angle junction or shoulder.

In order to block the locking device also in the second of the two main manipulation directions, the locking element comprises at least one blocking element, preferably a plurality of blocking elements, which ensure that the locking element is locked inside the cartridge chamber in case an attacker tries to urge the locking element out of the cartridge chamber from the muzzle side. The blocking elements are pressed against the cartridge chamber so that the locking element cannot be pulled or pushed out in the direction of the cartridge chamber. The pressing of the blocking elements against at least a portion of the cartridge chamber results in a frictional engagement so that the locking element cannot be removed in the direction of the cartridge chamber.

The embodiment according to FIG. 4 shows a locking mechanism according to the present invention which illustrates the principle of the self-locking effect. In this mechanism, the operating element 16 and the blocking elements 18 (for the sake of clarity only one blocking element 18 is shown) are provided such (cf., e.g., FIG. 4) that if pressure is exerted on the operating element 18 from the muzzle side of the barrel (in the following also called the distal end, since the locking element is inserted from the cartridge chamber which is proximal), the operating element presses the blocking element(s) 18 even further against the wall via the blocking element guide 16*a*. The blocking element guide is preferably conical with regard to the axial direction as can be seen in FIGS. 4 and 5. In other words, if pressure is exerted from the muzzle side, the blocking elements or balls 18 are pressed by the conical portion 16*a* of the operating element 16 against the wall of the cartridge chamber 420. Thus, self-locking effect means that if pressure is exerted from the muzzle side, the blocking elements are pressed even further against the cartridge chamber. The conical portion of the operating element may comprise separate blocking element guide surfaces 16*a* for each blocking element or ball 18. In particular the guide surfaces 16*a* for each blocking element may be separated by edges or partition walls such that a rotation of the blocking element is prevented. According to a preferred embodiment, the guide surface is not only conical in the axial direction of the locking element 42 but also comprises rams or inclined surfaces in the circumferential direction up to the partition walls. In other words, the conical surface of the operating element also urges the blocking balls 18 radially outwardly when the operating element 16 is rotated. Thus, when a person tries to manipulate the locking element by rotating the operating element, either by accessing the stem 160 from the muzzle side or accessing the connector support from the cartridge chamber side, a small rotational movement, e.g., a movement of less than 2°, would guide the blocking balls radially outwardly such that they are urged against the inner wall of the cartridge chamber.

As is shown in the schematic drawing in FIGS. 4 and 5, a spring element 31 biases the operating element in the proximal direction such that the tapered portion 16*a* of the operating element 16 urges the blocking elements 18 radially outwardly through the window or cut-out 81 to get into contact with the inner wall of the cartridge chamber 420. In other words, the operating element 16 is axially movable within the sleeve, i.e., the operating element is axially movable relative to the sleeve 14. When the operating element is moved to the distal direction relative to the sleeve, the blocking elements 18 are allowed to move in a retracted position such that the locking element 42 is unlocked. As can bee seen in FIG. 5, there is a recess portion 16*b* into which the blocking elements 18 or balls 18 can move such that the blocking elements move radially inwardly. Thus, depending on the position of the operating element 16 relative to the sleeve 14, the blocking elements are either retracted or extended. The locking element of the present invention comprises preferably a means which biases the operating element in such a position that the blocking elements are in the extended position. This biasing means 31 ensures that a locking element once inserted into the cartridge chamber is biased into the locking state and therefore locked within the cartridge chamber. Any manipulation from outside results in a further locking state, wherein the blocking forces of the blocking elements 18 to the cartridge chamber are increased when the locking element 42 is manipulated from the muzzle side. This mechanism has been described above as self-blocking mechanism. The biasing means may be a spring element like the spring element 31 illustrated in FIG. 5. The spring element 31 is located between the sleeve 14, in particular between the distal shoulder 80 of the sleeve 14 and a flange 16*c* of the operating element 16 for biasing or urging the operating element to the proximal direction relative to the sleeve 14. Since the conical portion 16*a* of the operating element has a larger diameter at the distal end, the blocking elements 18 are pressed radially outwardly against the cartridge chamber. The removal of the locking element 42 from the cartridge chamber 420 from the muzzle side is prevented by the frictional connection of the corresponding blocking elements 18 which are urged against the cartridge chamber. In addition, when pressure is exerted on the operating element 16 from the muzzle side, the tapered portion 16*a* on operating element 16 causes the blocking elements 18 to be pressed even further against the wall of the cartridge chamber so that the blocking element 18 is pressed even further against the cartridge chamber.

Furthermore, when pressure is exerted on the proximal end of the locking element from the cartridge chamber side, the operating element 16 is moved within the sleeve 14 into the distal direction such that the blocking elements are allowed to move in the retracted direction. However, a removal into the proximal direction of the locking element is not possible since a force is exerted into the distal direction. In case the force into the distal direction is lowered, the biasing force of the spring 31 will urge the blocking elements again radially outwardly. In other words, a force from the proximal end to the distal direction of the sleeve (from the cartridge chamber side to the muzzle side) may unlock the blocking mechanism, but due to that force, a removal is not possible. In case the force is reduced, the locking mechanism will lock the locking element again in the cartridge chamber. Even a much stronger force into the distal direction will not allow a removal of the locking element since the larger diameter of the locking element abuts against the junction between the cartridge chamber and the barrel. In other words, manipulation with a force to the distal direction (from the cartridge chamber to the muzzle) presses the locking element even further into the cartridge chamber and blocks the locking element even further within the cartridge chamber when the force is reduced. In one direction, a form fitting engagement is provided whereas in the other direction a frictional engagement is reinforced and a self-locking effect is achieved. That means if an unauthorized party tries to manipulate the locking element by exerting pressure on the locking element, he causes the blocking elements to be pressed even further against the cartridge chamber walls via the operating element.

In one embodiment of the present invention, the operating element 16 preferably comprises a conical portion 16*a*. The operating element 16 can be formed as one component or may comprise several components. Preferably the operating element 16 is provided at the distal end of the locking element 42 and connected, preferably via at least one intermediate element to an element at the proximal end, preferably fixedly connected to said element. According to a further preferred embodiment, the operating element 16 is rotatably connected to the element at the proximal end, i.e., the element at the proximal end is rotatable relative to the operating element 16. The element at the proximal end and the operating element 16 are preferably movable within the sleeve, i.e., movable relative to the sleeve 14. According to a preferred embodiment the operating element 16 is longitudinally movable and/or rotatably movable with regard to the sleeve 14. Alternatively or additionally, the element at the proximal end and optionally the intermediate elements is/are longitudinally movable and/or rotatably movable with regard to the sleeve 14. Alternatively or additionally, the element at the proximal end is longitudinally movable and/or rotatably movable with regard to the operating element 16.

The element at the proximal end is preferably a connector support 61. Said connector support preferably comprises a connector 60. In particular, if the connector support 61 and the operating element 16 are mounted such that a relative movement between each other is possible, a manipulation attack with a rotating drill at the connector 60 will not transfer the torque from the connector support 61 to the operating element 16 and vice versa.

As mentioned above, the locking element is preferably locked and unlocked by means of a separate operating unit 4. The connector 60 is adapted for mechanically and/or electrically coupling of the operating unit 4 with the locking element.

The connector support 61 may be fixedly connected to the operating element 16, e.g. by means of a pin which may be arranged inside a pinhole 62 (see FIG. 6). As mentioned above, a relative longitudinal movement between the connector support 61 and the operating element 16 may be possible. For instance, the operating element 16 may comprise the pinhole 62 in form of an elongated hole or transverse bore which accommodates the pin 26 (see e.g. FIGS. 11A and 11B) or a pin portion. According to a further embodiment, the operating element 16 may be mounted to the connector support 61 such that a relative rotational movement is possible. According to still another embodiment, the connector support 61 and the operating element 16 may be firmly connected or formed as one component from one piece.

Figure 8:
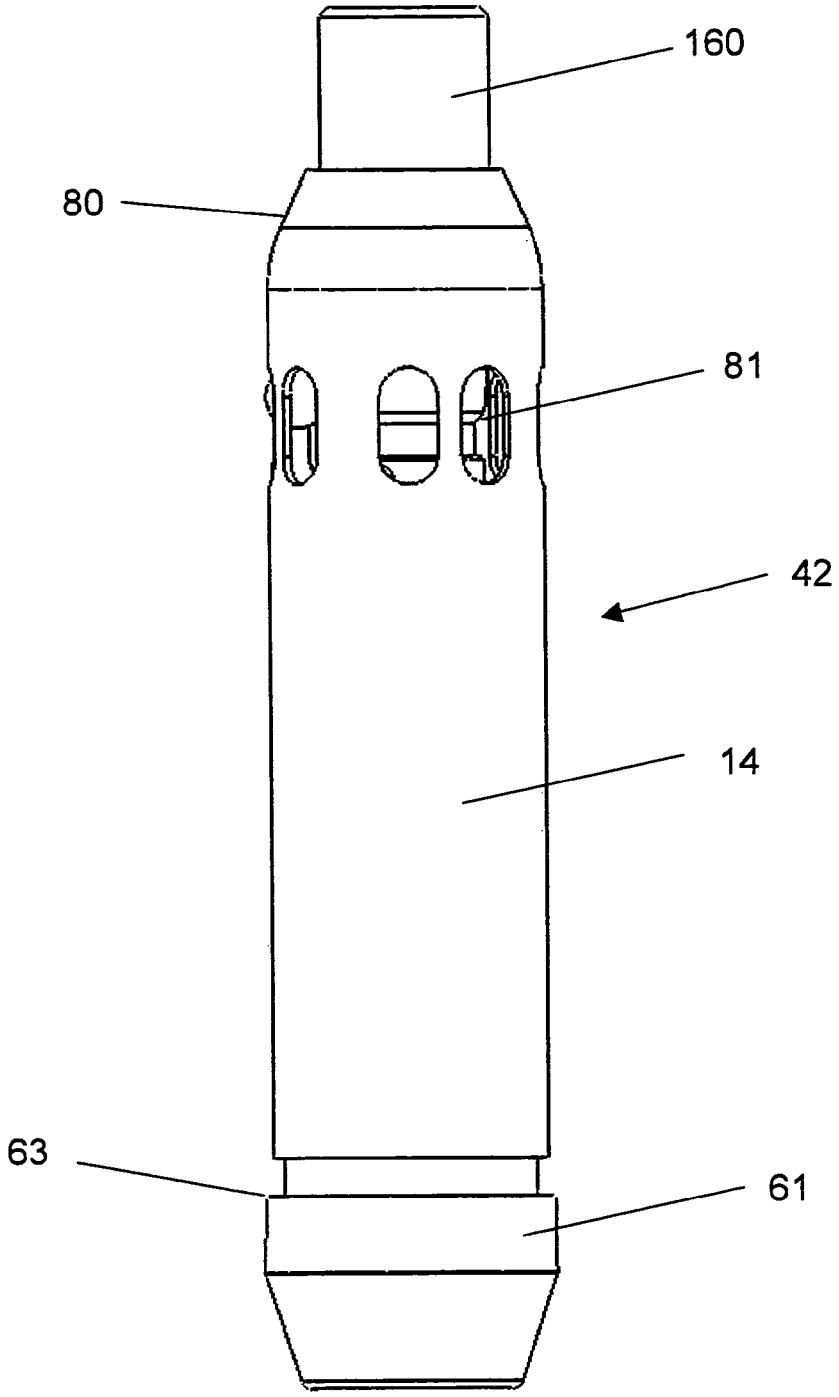
FIG. 8 shows an outer view of the locking element similar to FIG. 2.

The connector support 61 at the proximal end of the locking element 42 is preferably arranged such that the connector support 61 is the only accessibly part of the locking means from the cartridge side when the locking element 42 is locked inside the cartridge chamber. In other words, it is preferred that the connector support extends radially beyond the sleeve 14 (see, e.g., FIG. 8) such that the sleeve 14 is not accessible from the outside when the locking element 42 is located inside the cartridge chamber. As shown for example in FIGS. 6 and 8, the connector support comprises an edge 63 which is located in front of the sleeve 14 (seen from the proximal direction) such that the sleeve 14 is not accessible from the outside. A similar principle is preferably valid for the distal end of the locking element 42. In particular, the operating element 16 extends preferably in form of a cylindrical stem 160 beyond the distal end of the sleeve 14. The stem 160 is preferably located at least partly within the barrel when the locking element 42 is located inside the cartridge chamber. Preferably, the outer diameter of the stem matches substantially to the diameter of the barrel such that the sleeve 14, which preferably abuts against the junction (e.g. against the shoulder) between the cartridge chamber 420 and the barrel, is not accessible from the muzzle side. Due to this design, the connector support 61 and the stem 16 are the only components accessible from the outside when the locking element is locked inside the cartridge chamber 420. Such a design prevents that the sleeve 14 is never accessible from the outside. Applying a force from the muzzle side will further urge the blocking elements against the cartridge wall. Applying a force from the cartridge side will "unlock the locking" means in the sense that the blocking elements are allowed to move temporarily in the unlocking or retracted state but will further push the locking element into the cartridge chamber.

In order to unlock the locking element and remove the locking element from the cartridge chamber 420, the operating element 4 should be removably fixed or mounted with the locking element and the locking element should be temporarily maintained in the unlocked state. In other words, for unlocking the locking element 42 one has to apply a force from the cartridge chamber side for moving the operating element 16 to the distal direction which causes the blocking elements 18 to move in the retracted or unlocked state. The spring element 31 would urge the operating element 16 back to the proximal direction when the force from the proximal direction is lowered, which would result again in a locking state. This proximal back movement of the operating element 18 should be prevented for removing the locking element from the cartridge chamber 420. Such a back movement is preferably prevented by means of a mechanism which comprises an actuator. In particular, the actuator activates a mechanism which prevents a movement of the operating element back to the proximal direction in order to temporarily "fix" or keep the operating element in the unlocked state or position. In the following, the term "temporarily fixing" refers to a temporary state which may be actuated by means of an actuator and released by deactivating an actuator, i.e., temporarily fixing refers to a temporarily and releasably fixing or attaching. It is important that the operating element 16 is not urged back into the locking position by means of the spring element 31. The temporarily fixing may be achieved either by preventing a movement of the operating element in the proximal direction, i.e., a movement in the distal direction would still be possible or may be achieved by fixing the operating element temporarily with respect to the sleeve 14 such that both movements, i.e., in the proximal and the distal direction are prevented.

When the operating element 16 is temporarily fixed in the unlocked position, it is possible to remove the locking element 42 from the cartridge chamber to the proximal direction, i.e., to the direction of the cartridge chamber. This removal may be achieved by orientating the barrel with the cartridge chamber in a substantially vertical direction such that the gravitational force removes the locking element from the cartridge chamber. According to a further preferred embodiment, the operating element 4 couples mechanically to the connector support 61 and/or the connector 60 such that the mechanical coupling force is large enough that the locking element 42 may be removed by means of the operating element 4. In other words, once the operating element 4 is mechanically coupled with the locking element 42, a force to the axial direction is needed to remove the operating element 4 from the locking element 42. Said force is preferably larger than a predetermined amount, preferably larger than 1 N, more preferably larger than 2 N, more preferably larger than 5 N, more preferably larger than 10 N, more preferably larger than 10 N, or even larger.

This mechanical coupling between the operating element 4 and the locking element 42 is also advantageous for the locking step, i.e., when the locking element 42 is inserted into the cartridge chamber. For locking the firearm, there are in principle two ways. Firstly, the locking element may be inserted easily by hand into the cartridge chamber from the cartridge chamber side until the shoulder of the locking element 42 abuts at the junction between the cartridge chamber and the barrel. When the inserting force is lowered, a locking of the locking element is achieved by the biasing spring element 31 which presses the operating element 16 to the proximal direction and therefore urges the blocking elements 18 radially outwardly against the inner wall of the cartridge chamber. The locking or blocking force, i.e., the force by which the blocking elements are pressed against the cartridge chamber walls is determined by the spring element 31. Secondly, the locking element 42 may be inserted by means of the operating element 4. The operating element 4 is preferably mechanically coupled with the locking element 42. Again, the locking element 42 is inserted until the locking element 42 abuts against the shoulder or junction between the cartridge chamber and the barrel. The spring 31 biases the operating element back into the proximal direction and urges the blocking elements radially outwardly when the inserting force is reduced, i.e., the locking element is locked within the cartridge chamber. In order to remove the operating element 4 from the locking element 42, a user pulls at the operating element 4 towards the proximal direction. Since the user has to apply a force which is larger than a predetermined amount, said predetermined amount of force is applied on the operating element 16 to the proximal direction which is transferred into the radial outward force of the blocking elements 18. In other words, if the predetermined amount for removing the operating element 4 from the locking element 42 is larger, the locking element will be locked with a larger pressure against the cartridge chamber walls.

However, a larger pressure against the cartridge chamber would also result in a larger imprint or wear of the cartridge chamber walls. It is therefore preferred to adjust the predetermined force with the hardness of the blocking elements 18 such that a sufficient blocking is achieved when the locking element is inserted but a wear of the cartridge chamber wall is small. For ensuring a safe blocking of the locking element in case of manipulation, it is preferred that the blocking elements are formed from a material which is sufficiently harder than the material of the cartridge chamber, which ensures that the blocking elements enter or penetrate into the cartridge chamber wall which increases the locking force. It is therefore preferred that the blocking elements 18 are as hard as possible. However, in case the locking elements are too hard and the above mentioned predetermined force for removing the operating element from the locking element is too large, an insertion of the locking element would already result in a wear of the cartridge chamber. It may be advantageous to provide at least two kinds of blocking elements, e.g., blocking elements with lower and higher hardness. For instance, the blocking element with lower hardness may be formed or arranged within the locking element that the lower hardness locking elements abut against the cartridge chamber wall when the locking element is inserted into the cartridge chamber which results in a reduced wear of the cartridge chamber. The locking elements with the higher hardness are formed and/or arranged such that they are only pressed against the cartridge chamber wall in case of manipulation. For instance, when the blocking elements are balls 18, the lower hardness balls may comprise a (slightly) larger diameter than the balls with the higher hardness. According to another preferred embodiment of the present invention, the conical shape 16*a* of the operating element 16 may be different for the lower hardness balls and the higher hardness balls such that the lower hardness balls are pressed first against the cartridge chamber walls and the higher hardness balls are pressed against the cartridge chamber wall only when higher forces, such as manipulation forces are applied at the locking element. It is also possible to provide blocking elements with at least two layers, e.g., balls with an outer layer with lower hardness and higher hardness in the middle of the ball. Such a design would press the outer layer against the cartridge chamber wall without damaging the wall. In case higher manipulation forces are applied, the harder core ensures that the blocking balls engage with the cartridge wall, i.e., the inner core is pressed firmly against the wall of the cartridge chamber by the operating element so that it forms a frictional connection with the cartridge wall or even deforms the inner walls of the cartridge chamber which eventually results in a form fitting connection between the blocking elements and the deformed cartridge chamber.

As mentioned above, the junction between the cartridge chamber and the barrel may be formed differently for different firearms. For instance, a handgun comprises typically a small step between the cartridge chamber and the barrel. A long gun comprises typically a conical shoulder between the cartridge chamber and the barrel (see FIG. 1*c*). Moreover, a shotgun typically comprises a conical junction between the cartridge chamber and barrel with a small conical angle. When a locking element 42 as shown for example in FIG. 2 is inserted (e.g. with a large force) into the cartridge chamber of a shot gun with a small angle junction, there exists the potential risk that the locking element will jam in the junction. In particular, there exists the known phenomenon that a jamming occurs when the conical angle is below a critical angle. In order to prevent such a jamming, the locking element of the present invention may comprise a further mechanism at the distal end of the locking means, which prevents such a jamming inside the junction between the cartridge chamber and the barrel.

Figure 9:
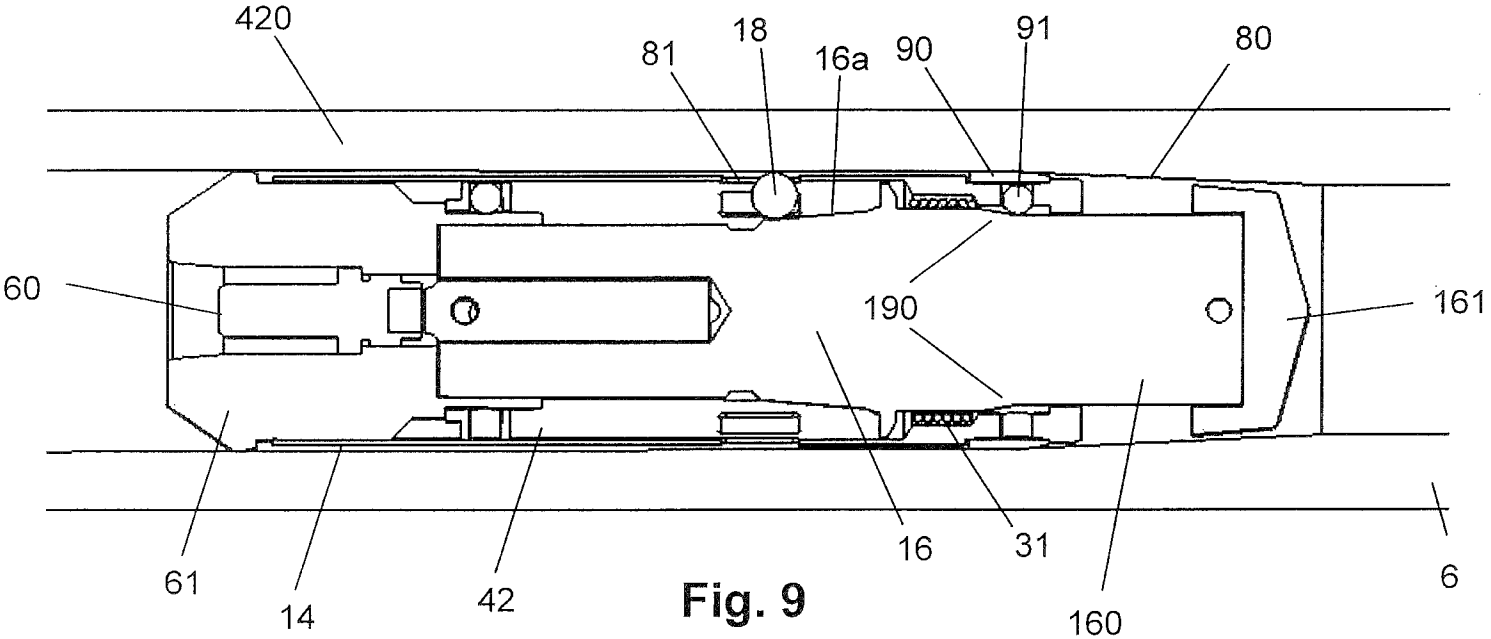
FIG. 9 shows a cross-sectional view of an embodiment especially adapted for shot guns or pellet guns.

According to a further embodiment of the present invention, an anti-jamming mechanism is provided at the distal end of the locking element as shown for example in FIG. 9. FIG. 9 shows a part of a cartridge chamber 420 at the left side and a part of the barrel 6 at the right side and between the cartridge chamber and the barrel a junction 80 with a small conical angle is illustrated. Similar to the above-described embodiment, a connector support 61 with connector 60 and the operating element 16 are located within the sleeve 14. The locking mechanism with the blocking elements 18, which may be urged out of the sleeve cut-out 81 is similar to the above discussed embodiments. However, an anti-jamming mechanism is provided at the distal end of the sleeve 14 around the stem 160 of the operating element 16.

Figure 10:
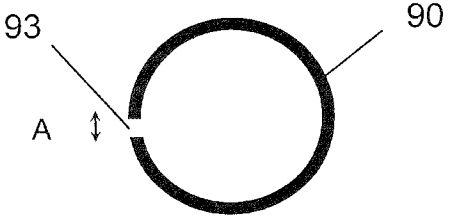
FIG. 10 shows a top view of a ring element as used in the embodiment shown in FIG. 9.

When the locking element 42 is inserted from the cartridge chamber side, a tactile means provided at a shoulder portion of the locking element, e.g., a ring element 90, gets into contact with the conical junction 80 between the cartridge chamber and the barrel. When the locking element is advanced further into the cartridge chamber 420, the stem 160 of the operating element 16 will move relative to the sleeve 14 to the distal end. The stem 160 comprises a conical portion 190 with a diameter that increases to the proximal direction. This conical portion 190 engages with rolling elements, e.g. balls 91, which will be urged radially outwardly when the stem 160 is moved further to the distal direction (direction during insertion) relative to the sleeve 14. The radially outwardly urged balls 91 will not be directly urged to the inner wall of the cartridge chamber but will expand the ring element 90 which gets into further contact with the inner wall of the cartridge chamber. The ring comprises preferably a slit 93 as shown in the top view of single ring element 90 (see FIG. 10). When the balls 91 are urged or pressed radially outwardly, the ring 90 will expand such that the distance "A" of the slit 93 will increase. As a result, the circumferential length and the diameter of the ring element 90 will increase such that a further advancing of the locking element 42 to the distal direction is prevented. In other words, instead of abutting a fixed shoulder—as described in the above embodiments—a variable shoulder abuts against the junction between the cartridge chamber and the barrel. This variable shoulder prevents that the locking element 42 is further advanced to the distal direction. The expandable ring elements 90 provide such a "variable shoulder" of the locking element 42. When the inserting force is lowered, the locking element will be locked with a similar mechanism as described in the above embodiment, i.e. the operating element will be urged to the proximal direction by means of the spring element 31 such that the conical portion 16*a* urges the blocking elements 18 against the inner wall of the cartridge chamber.

In the unlocking step, the expanded ring element will shrink, i.e., the distance A of the slit gets smaller such that the jamming of the locking element is prevented. In particular, similar like in the above described unlocking step, the operating element will be forced to the distal direction such that the blocking elements 18 are in the retracted or unlocked position. Such a movement to the distal direction is for example possible if there exists a relative position between the sleeve 14 and the operating element in which position the ball elements 18 and 91 are slightly retracted. In other words there may exist an interval in which a the ball elements 18 and 91*a* slightly retracted such that neither the ball element 18 press against the cartridge chamber wall nor the ball elements 19 urge the ring element 90 against the cartridge chamber wall such that the locking element can be removed from the cartridge chamber to the proximal direction. The actuator and the temporarily fixing means preferably fix the operating element is this interval. In order to provide such an interval, the position of the cones and/or the cone angles may be adjusted accordingly such that a removal is possible. Furthermore or alternative, the blocking elements 18 and/or the ball elements 81 are provided with some play within the sleeve, e.g. with some tolerance, such that this play provides the above mentioned interval for unlocking the locking element. In particular, it may be preferred that the ring 91 comprises some play with regard to the sleeve such that a removal of the locking element is further assisted.

Figure 11A:
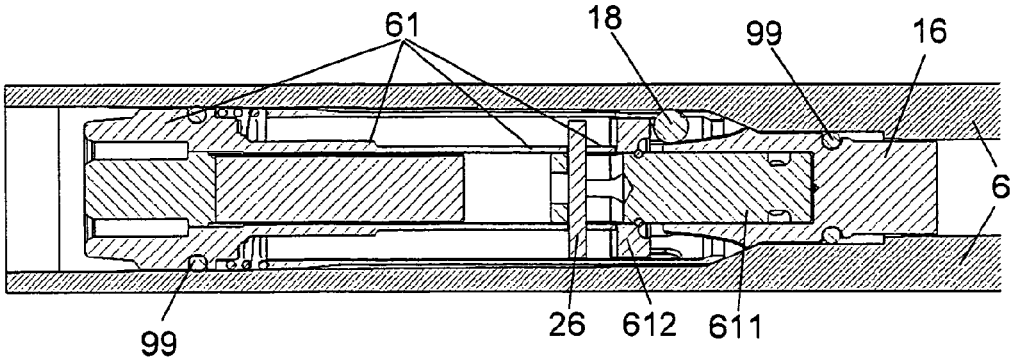
FIG. 11A show a cross-sectional view of a further preferred embodiment of a locking element according to the present invention.
Figure 11B:
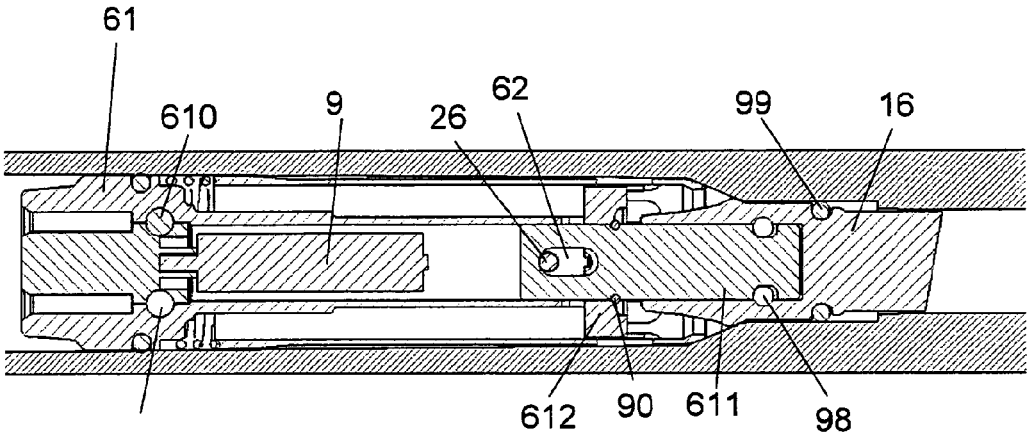
FIG. 11B shows the cross-sectional view of FIG. 11A but 90° rotated around the longitudinal axis of the locking element.
Figure 11C:
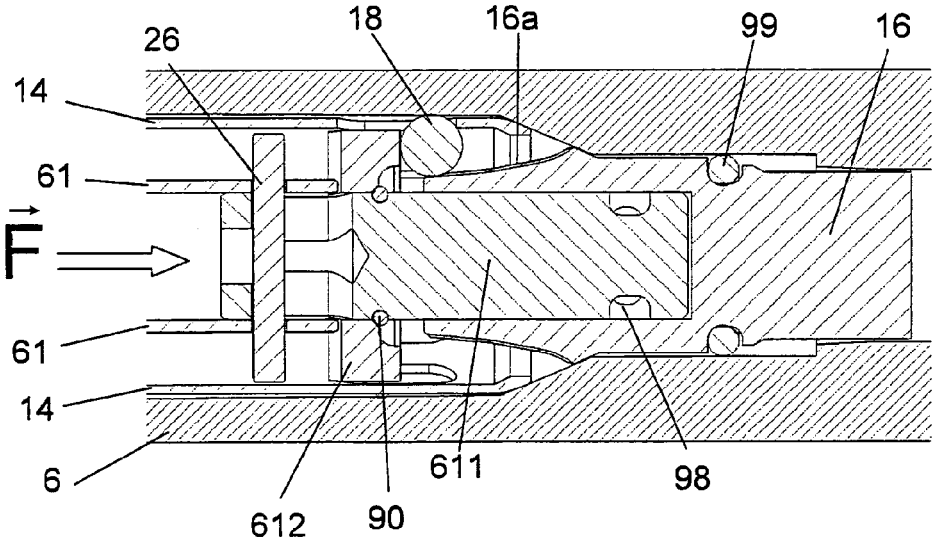
FIG. 11C shows an enlarged view of FIG. 11A.

FIGS. 11A to 11C show a further preferred embodiment according to the present invention. FIG. 11B show the locking element of FIG. 11A but rotated 90° around the longitudinal axis of the locking element. FIG. 11C is an enlarged view of the distal portion of FIG. 11A. The design of this embodiment is very similar to the design as shown in FIG. 4, however, further safety features will be discussed in the following with regard to FIGS. 11A to 11C. These additional features are, however, not limited to the particular embodiment of FIGS. 11A to 11C, i.e., only one or a plurality of the following features may be provided within any locking element 42 according to the present invention.

For instance, FIG. 11B shows a further protection means against drilling 610. In particular, the protection means 610 against drilling is preferably provided at the proximal portion of the locking element 42, e.g. at/in the connector support 61. The protection means against drilling 610 comprises preferably hard alloy. According to a preferred embodiment, at least one, preferably two, three or more metal spikes 610, made of hard alloy, are arranged transversely in the connector support, preferably substantially orthogonal with regard to the longitudinal direction of the locking element 42. FIG. 11B shows two metal spikes 610 which are press-fitted in the connector support 61 (not visible in the 90° rotated FIG. 11A). Thus, if a manipulator tries to drill the locking element from the proximal end with a drill, i.e., from the side of the connector support 61, the spikes 610 will cause the drill to break off, blunt and/or stuck. In any case, the spikes 610 ensure that a drill will not move beyond the spikes in the direction of the distal part of the locking element 42. A similar construction may be additionally or alternatively provided at the distal end of the locking element 42, e.g., within the operating element 16. Accordingly the hard alloy spikes (which are preferably arranged transversal to the longitudinal direction of the locking element) ensure that a drill will not drill beyond the spikes to the direction of the proximal part of the locking element.

The distal end of the operating element 16 may be further shaped such that the locking element 42 is further protected against an attack with a drill from the barrel. In particular, the distal end of the operating element 16 may be skewed in the longitudinal direction as shown for example in FIG. 11B (not visible in the 90° rotated FIG. 11A). According to a further preferred embodiment the distal end of the operating element 16 may be tapered in the distal direction such that a drill of an manipulator will be automatically guided laterally away from the operating element 16 to the inner wall of the barrel, i.e., it is likely that the drill will not drill the operating element but rather destroys the barrel.

FIGS. 11A and 11B further show gaskets 99 which may be mounted at or proximal to the proximal end and/or the distal end of the locking element 14. In particular, a gasket ring 99 is provided at the connector support 61 and a gasket ring 99 is provided at the operating element 16 of the embodiment as shown in FIG. 11A-C. These gasket rings 99 ensure that any fluid, e.g., fluid which may damage the functionality of the locking element 42, will not enter into the cartridge chamber when the locking element is inside the cartridge chamber. In other words, the gaskets prevent fluid from entering the locking element.

As already discussed above, the operating element 16 may be rotatably connected to the connector support 61. For instance, if the operating element 16 is "detachable fixed" or "fixed" to the cartridge chamber by means of the blocking elements 18, the connector support 61 may still be rotatable with regard to the operating element 16 and/or within the cartridge chamber. FIGS. 11A to 11C show an example how such a rotational movement may be realized. In particular, the connector support 61 extends from the proximal end longitudinally to the distal portion of the locking element (see FIG. 11A). The connector support 61 is designed as a sleeve at its distal end, wherein an intermediate bolt 611 is located with its proximal end within the sleeve portion of the connector support 61. The distal end of the intermediate bolt 611 is connected with the operating element 16. Again, the operating element 16 may be designed as a sleeve at its proximal end such that the intermediate bolt 611 is located in the sleeve portions of the connector support 61 and the operating element. The intermediate bolt 611 comprises a hole or slot 62. The connector support 61 also comprises a hole at the distal end, wherein the connector support and the intermediate bolt 611 are connected via a pin 26, which is located in the hole of the connector support 61 and the slot 62 of the intermediate bolt 611. Moreover, the intermediate bolt 611 is connected with the operating element 16 via a bearing 98. For instance, the bearing 98 may be a ball bearing, which allows the intermediate bolt 611 to rotate relative to the operating element 16. According to another preferred embodiment, the intermediate bolt 611 comprises a circumferential notch next to the distal end, wherein two pins, which are fixed to the operating element 16 and arranged transversely with respect to the longitudinal axis of the locking element 42 engage with the circumferential notch; again intermediate bolt 611 with the circumferential notch is rotatable relative to the operating element 16. In other words, the combination of the connector support 61, the intermediate bolt 611 and the operating element 16 form a "unit" which is movable within the sleeve 14.

This "unit" will be destroyed if a strong manipulation force (preferably larger than the typical forces during normal operation) acts from the proximal end of the locking element 42 in the direction of the distal end. The "unit" will break at a predetermined breaking point, which activates a further security feature. In particular, if a strong force acts from the proximal end of the locking element in the direction of the distal end (in FIG. 11C from left to right; see arrow $\vec{F}$), the sleeve portion of the connector support 61 is pushed against a clamping guide 612. In normal operation of the locking element 42, the clamping guide 612 is prevented to move distally, i.e., it is prevented that the clamping guide 612 engage with the locking elements 18 by means of a sheering ring 90, e.g. a ring 90 which is arranged in a circumferential notch in the intermediate bolt 611. However, in case the external manipulation force is large enough, the clamping guide 612 shears-off or breaks the shearing ring 90 such that the clamping guide 612 engages with the locking elements 18 and pushes the locking elements 18 in the distal direction. The locking elements 18 are further guided by the conical portion 16*a* outwardly against the inner wall of the cartridge chamber, i.e., the locking element 42 is locked in the cartridge chamber if a manipulator applies a strong force, e.g., strong beat, on the connector support in the distal direction.

Moreover, since the shearing ring 90 breaks, the clamping guide is press fitted by means of the broken shearing ring 90 to the intermediate bolt 611. Thus, the broken shearing ring 90 substantially prevents the clamping guide 612 from moving back in proximal direction, i.e., locking element 42 remains in the locked position after a manipulator applied a strong force, e.g., strong beat, on the connector support in the distal direction.

As already discussed above, it is important that the sleeve is not accessible from the outside when the locking element is inside the cartridge chamber. This is achieved by the stem 160 and the connector support 61 in the above embodiment. The embodiment for the shotgun comprises at the proximal end a similar connector support. At the distal end, there may be provided a cap 161 which prevents that the sleeve 14 of the ring element 90 is accessible from the muzzle side when the locking element is locked inside the cartridge chamber.

According to a preferred embodiment, an authentication is only carried out for the unlocking step while locking can be effected without authentication. When a user is authenticated for carrying out the unlocking step an actuator is operated to prevent a proximal movement of the operating element 16 or to temporarily fix the operating element 16 with the sleeve 14. In other words, the actuator is actuated for temporarily fixing or keeping the locking element in the unlocked state. The actuator is preferably located in the locking element 42, but it can also be provided in the operating unit 4. The actuator can for example comprise at least one wire element comprising a shape memory alloy, and at least one electric motor and/or at least one magnet array, for example an electromagnet array. An exemplary actuator 92 in the form of a one wire element is illustrated in FIG. 4. However, the invention is not restricted to the above-mentioned embodiments of an actuator. The listed embodiments merely represent some examples of actuators for operating the operating element. In addition to the mentioned examples, there are further possibilities. Actuators fulfilling the above functions based on the given energy or force conditions are suitable.

For instance the actuator may comprise a wire element which comprises a so-called shape memory alloy, for example a nickel-titanium alloy. Upon heating, such a shape memory alloy shrinks in length for example by about 4% or more. The actuator may apply a force to a temporary fixing means such that this temporary fixing means provides a temporarily fixing between the operating element 16 and the sleeve 14. For instance the actuator may move a temporary fixing means with an axial direction within the sleeve 14.

Figure 7:
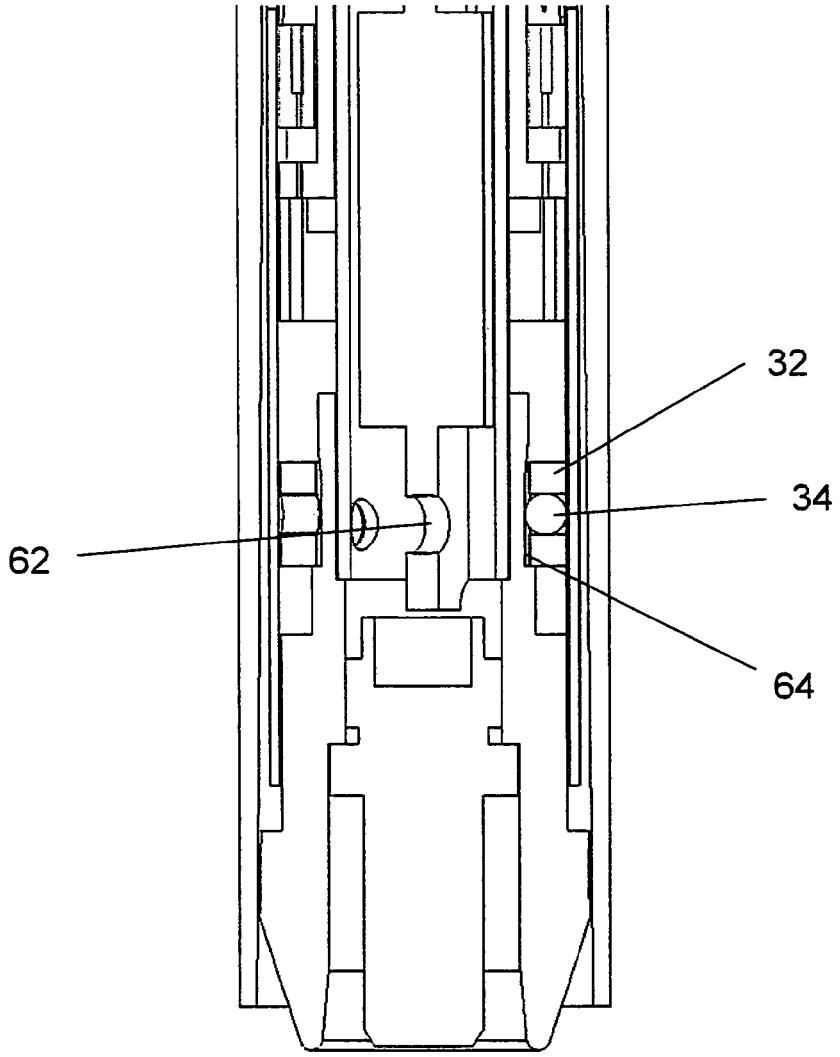
FIG. 7 shows an enlarged cutaway view of the proximal end of FIG. 6.

The temporary fixing is preferably provided with a ball-check arrest 32, 34 comprising a cage 32 provided around the operating element 16 and/or the connector support 61 as shown in FIGS. 4 and 6. The ball-check arrest may be moved (preferably continuously) axially within the sleeve 14 between a proximal position and a distal position. The ball-check arrest comprises at least one ball element 34 as, e.g., shown in FIGS. 4 and 6. The ball element(s) 34 is/are pressed outwards against the sleeve 14 when the conical portion 64 (see FIG. 7) of the operating element 16 engages with the ball elements 34. In particular, the conical portion 64, which may be provided at the operating element or at the connector support 61 as shown in FIG. 6 comprises at the distal end a larger diameter and a smaller diameter at the proximal end. When the check-ball arrest is moved in the distal position or when the ball-check arrest is located in the distal position and the operating element 16 and/or the connector support 61 move to the proximal direction, the ball element will engage with the conical portion 64 and will be urged radially outwardly against the inner walls of the sleeve 14, i.e., the operating element and/or the connector support are temporarily fixed to the sleeve 14. In other words, the operating element 16 is prevented from moving back into the proximal direction when the cage 32 is pulled forward (into the distal direction) by means of an actuator. The ball-check arrest 32, 34 acts as a stop for temporarily fixing the operating element to the sleeve 14. Thus, depending on the position of the ball-check arrest 32, 34 the relative movement between the operating element 16 and the sleeve is restricted/temporarily fixed or not restricted. The actuator is preferably located inside the sleeve 14 such that it can control the movement of the ball-check arrest within the sleeve. It is not necessary that the actuator is fixed inside the sleeve 14 for moving the ball-check arrest. For instance stops may be provided, i.e. floating bearings, fixed bearings, spring elements, which allow certain relative movements within the sleeve 14 which further ensure that the mechanism may not be manipulated from the outside. In other words, the actuator is provided within the sleeve 14 to control the relative position between the operating element 16 and the ball-check arrest 32, 34 such that a temporary fixing of the operating element to the sleeve occurs or not.

In one embodiment of the present invention, the self-locking firearm safety system comprises a locking element 42 and preferably a separate operating unit 4 (see FIG. 3). The operating unit 4 preferably remains outside of the cartridge chamber 420. The operating unit 4 can be coupled mechanically and/or electrically with the locking element 42. The operating unit may comprise a battery 44 for energizing the operating unit 4 and/or the locking element 42. The operating unit has preferably two objects.

Firstly, the operating unit 4 may be adapted for transmitting and/or receiving data (unidirectional or bidirectional) for the authentication and the subsequent locking and/or unlocking step. Furthermore, the operating unit couples mechanically to the locking element 42 for inserting the locking element into the cartridge chamber and locking the locking element within the cartridge chamber and for unlocking and subsequently removing the locking element from the cartridge chamber.

The transmission of data between the locking element 42 and the operating unit 4 can be effected via a wire or in a wireless manner. A wireless coupling can be effected via radio, for example by means of an inductive coupling, in the very low frequency, low frequency, medium frequency and/or high frequency band, e.g. in the range of 3 kHz to 30 Mhz. The wireless coupling can furthermore also be effected via an optical coupling or an electromagnetic coupling in the microwave and UHF frequency range for example from 400 MHz to 5 GHz. In the case of a wired transmission, transmission is for example effected via a 1-wire bus (see, e.g., 48 in FIG. 3). The coupling between the operating unit 4 and the locking element 42 can also be a combination of the above-mentioned possible couplings. Data and/or energy can be transferred between the operating unit 4 and the locking element 42.

The operating unit 4 can be connected to the locking element 42 via a coupling unit or connector 60 to unlock and/or re-lock the locking element 42 in the firearm cartridge chamber 420.

According to a further preferred embodiment, there is an electronic device 9 located within the locking element 42 for controlling the locked and unlocked state of the locking element. The electronic device 9 can be provided in the locking element 42 for operating the actuator. According to a preferred embodiment, for unlocking the locking element the actuator, be it a wire element and/or an electric motor and/or a magnet array etc., has to be operated via the electronic device 9.

The electronic device 9 is preferably located within the locking element 42, but it can also be provided in the operating unit 4. The electronic device 9 within the locking element provides the advantage that it is located with a safety area when the locking element is locked inside the cartridge chamber. The electronic device 9 carries out an authorization examination and/or activates or controls the actuator for locking or unlocking the locking element 42. The operating unit 4 serves to enter data (e.g. entering a PIN code and/or biometric data) wherein the data is transferred from the operating unit 4 to the electronic device 9 for the authorization examination.

The electronic device 9 can be self-sufficient, e.g. via a battery 10, and/or not self-sufficient or partially self-sufficient, wherein energy is provided via the operating unit 4 for example via a wire or a cable. Alternatively, energy can also be provided inductively.

This electronic device 9 allows the locking element to be unlocked easily if a wire element is used as the actuator. However, if instead of the wire element an electric motor or a magnet array e.g. with a coil are used as the actuator, the actuator is operated via the electronic device 9 to unlock the locking element 42. The electronic device 9 can for example be provided at a suitable location in the locking element. The electronic device 9 is for example a subminiature electronic device. It is connected to an electronic device in the operating unit 4 (not depicted) via encoded communication such as a 1-wire data bus 48 and can for example verify a correct authentication of a user.

If a user is identified as an authorized user, the electronic device 9 activates the actuator such that the operating element 16 is prevented from moving into the proximal direction. Thus, when a user firstly presses the operating element to the distal direction which allows the blocking elements to move in a retracted position, i.e., which unlocks the locking element 42 and subsequently activates the actuator (e.g. the wire element shrinks and pulls the check-ball arrest to the distal direction), the locking element 42 is kept or temporarily fixed in the unlocked state such that the locking element may be removed from the cartridge chamber.

In particular, for unlocking the locking element 42 when a wire element is used as an actuator, the electronic device 9 causes the wire element 42 to be heated, e.g. by means of resistance heating (not depicted), and thus to shrink in length. This in turn causes the ball-check arrest 32, 34, to which the wire element 42 is attached, to be pulled in the direction of the muzzle of the barrel (in the distal direction). This way, the operating element 16 is prevented from moving back to the proximal direction. The locking element 42 is kept in the unlocked state.

In order to protect the locking element 42 against manipulation, another wire element (not depicted) is provided. If a third party attempts to unlock the locking element 2 by heating the firearm from the outside, e.g. over a gas flame, the first wire element 42 shrinks in length. However, at the same time, the second wire element (not depicted) shrinks in length as well. As a consequence, the second wire element provides a counter-force to the (first) wire element. This causes the ball cage to be essentially unable or hardly able to move. According to a preferred embodiment, the two wire elements are arranged such that the acting forces cancel each other when both wire elements are heated.

The locking element 42 has to be unlocked before it can be removed from the firearm. This is effected by connecting or coupling the separate operating unit 4 with the locking element 42. However, instead of a separate operating unit 4 it is basically also conceivable to provide the operating unit 4 directly in the locking element 42. In an alternative embodiment, the electronic device 9 of the locking element can also be located in the separate operating unit 4 instead of in the locking element 42 itself so that the locking element essentially only contains the mechanical components.

The operating unit 4 and the locking element 42 can be connected via a coupling mechanism. The separate operating unit 4 has the advantage that it can be stored independently of the locking element 42. This means that after locking the firearm, the operating unit 4 can be removed from the locking element 42 for example in order to be stored in a safe location. Furthermore, it is possible to leave only the locking element 42 as an invisible safety device in the cartridge chamber which has the advantage that the firearm can easily be transported and stored.

Another advantage is that a great number of firearms can be secured with corresponding locking elements 42 which, however, can all be operated, i.e. locked and unlocked, by means of the same operating unit 4.

The locking element 42 is usually formed specifically for the caliber of a firearm, i.e. for example based on the diameter of cartridge chamber and the barrel and can for example be adapted as needed by the customer to the desired firearm.

In addition to the basic versions for self-loading firearms such as pistols and guns, variations for revolver and rifle calibers (e.g. shotguns for hunting) are offered as well. Firearms for hunting are usually characterized in that they are loaded manually from the cartridge chamber, i.e. from behind (tip-up principle) so that the locking element is installed in this manner as well.

The operating unit 4 can work with all variations of the locking element 42 independent of the number and types of the firearms to be secured. This is for example advantageous because one operating unit 4 can be used for different locking elements 42 adjusted to specific types of firearms based on their use. As was already mentioned above, this means that in general at most the locking element 42 has to be adjusted to a type of firearm but not necessarily a separate operating unit 4.

The operating unit 4 comprises a coupling unit which can be connected with the locking element 42 at any location, as long as, e.g., a data bus of the operating unit 4, preferably a 1-wire data bus, can be connected width the electronic device 9 of the locking element 42 or the electronic device to the actuator if the electronic device is provided in the operating unit 4 as well.

A multi-step authentication process is preferably used to secure the system. Each operating unit 4 can for example be provided with an individual password by the manufacturer which is stored in the operating unit 4. This password is for example transferred to every locking element 42 when it is first locked with this operating unit 4. Each unlocking process is initiated by transferring the password of the operating unit 4. Thus, only this specific operating unit 4 can be used for unlocking.

In addition, the use of an operating unit 4 can for example be secured by means of an authentication process. As was described above, this can be done using a PIN code and/or biometric data. Preferably, the PIN as well as the password of the operating unit 4 can be modified by the user.

The following means can be applied to secure the electronic systems and the communication channels (password transfer).

For example, a mechanical protection can be provided by a subminiature size and placing in the secured cartridge chamber portion. Furthermore, a surge protection can be provided for the electronics in the locking element (not depicted). Also, protection against wrong polarity as well as encoded communication between the operating unit 4 and the locking element 42 can be provided.

The above-described safety device for a firearm with their different embodiments, which can also be combined with each other, has the advantage that it offers a way to secure firearms throughout entire administrative levels. It can be used in pools, such as, e.g., the joint use of firearms, operating units and the accompanying authorization administration, or it can be used to integrate facilities such as public authorities, departments or military units.

Apart from the possible technical adjustments to specific types of firearms, special emphasis is laid on the following features.

Firstly, the option of a central administration of the system by globally valid operating unit passwords. Secondly, the possibility of conferring user authorizations of the operating units 4 by individual unit-specific certificates. They can have temporal restrictions or limitations to a certain type or number of uses.

The possibility of on-line administration is another aspect. This can for example include a protocol of the unlocking and locking processes and/or a central authentication and/or a system-wide switch of the parameters.

The present invention is not restricted to the embodiments described above, but also encompasses embodiments which are obvious to the person of average skill in the art. Furthermore, features of the embodiments described above can also be combined with each other.

The invention claimed is:

1. Locking element configured to be inserted into a cartridge chamber of a firearm, said locking element being provided with a proximal end and a distal end, the locking element comprising:

an outer sleeve with a movable operating element provided therein, wherein the sleeve comprises a diameter such that the locking element is snugly insertable into the cartridge chamber from a cartridge chamber side, said diameter being larger than a diameter of a barrel of the firearm, and the operating element projects partly beyond the sleeve at the distal end such that the operating element is accessible from a muzzle side of the barrel when the locking element is located in the cartridge chamber, at least one spherical blocking element provided within the outer sleeve, wherein the operating element is formed and provided such that when the locking element is inserted with the distal end first into the cartridge chamber the operating element is moved within and relative to the sleeve to a distal direction, such that the at least one spherical blocking element moves in a retracted state, wherein the operating element is biased by a spring element to a proximal direction such that when the operating element is moved within the sleeve to the direction of the proximal end, the operating element causes the at least one spherical blocking element to be urged radially outwardly and pressed against the wall of the cartridge chamber thus blocking the cartridge chamber, wherein the at least one spherical blocking element is pressed further against the wall of the cartridge chamber if external pressure is applied from the distal end to the operating element, and an actuator for unlocking the locking element, wherein the actuator is adapted for temporarily preventing a relative movement of the operating element in the proximal direction, wherein an outside surface of the distal end of the sleeve comprises a shoulder portion configured to abut against a junction between the cartridge chamber and the barrel, said shoulder portion having a conical angle which is substantially equal to an angle of the junction.

2. Locking element according to claim 1, wherein the actuator is adapted for temporarily fixing a position between the operating element and the outer sleeve.

3. Locking element according to claim 1, wherein the actuator is operated via an electronic device and wherein said electronic device is preferably located within the sleeve.

4. Locking element according to claim 1, wherein the operating element is constructed such that the at least one blocking element moves into a position in which said at least one blocking element is retracted and not pressed against the wall of the cartridge chamber when said operating element is moved in the distal direction relative to the sleeve and the at least one blocking elements remain preferably in the retracted position when said operating element is prevented from moving back in the proximal direction.

5. Locking element according to claim 1, wherein the operating element is located in the barrel when the locking element is inside the cartridge chamber.

6. Locking element according to claim 1, wherein the operating element comprises a conical portion for urging the at least one blocking element radially outwardly into the direction of the cartridge chamber.

7. Locking element according to claim 1, wherein the spring element biases the operating element to the proximal direction such that the at least one blocking element is urged radially outwardly and pressed against the cartridge chamber when the locking element is located in the cartridge chamber.

8. Locking element according to claim 1, wherein the sleeve comprises cut-outs such that the at least one blocking element can extend partly beyond the sleeve and be pressed against the wall of the cartridge chamber, wherein the blocking element forms a frictional connection with the wall of the cartridge.

9. Locking element according to claim 1, wherein the at least one spherical blocking element is a plurality of blocking elements.

10. Locking element according to claim 9, wherein the spherical blocking elements are balls.

11. Locking element according to claim 9, wherein the blocking elements are made from a material which is substantially harder than the material of the cartridge chamber.

12. Locking element according to claim 1, wherein the locking element further comprises at the proximal end a connector support movable within the sleeve and linked with the operating element.

13. Locking element according to claim 12, wherein the connector support and the operating element are fixedly linked.

14. Locking element according to claim 12, wherein the connector support and the operating element are linked such that the connector support is rotatable relative to the operating element.

15. Locking element according to claim 12, wherein the connector support engages with a clamping guide which pushes the locking elements radially outwardly if a strong force acts on the connector support in the distal direction.

16. Locking element according to claim 12, wherein the connector support and/or the operating element comprise(s) a protection means against drilling made of hard alloy.

17. Locking element according to claim 12, wherein a gasket is provided at the connector support and/or the operating element for sealing the locking element against the cartridge chamber and/or the barrel.

18. Locking element according to claim 1, wherein the distal end of the operating element is skewed in the longitudinal direction.

19. Locking element according to claim 1, wherein the actuator activates a temporary fixing means for temporarily preventing a relative movement of the operating element in the proximal direction.

20. Locking element according to claim 19, wherein the temporary fixing means comprises a movable cage with a rolling element guide with at least one ball element and forms a ball-check arrest for temporarily preventing a relative movement of the operating element in the proximal direction.

21. Locking element according to claim 1, wherein the actuator comprises at least one first wire element and/or an electric motor and/or a magnet array wherein the magnet array preferably comprises at least one coil.

22. Locking element according to claim 1, wherein the locking element comprises a second wire element which provides a force directed opposite to the first wire element when both wire elements are heated.

23. Locking element according to claim 22, wherein both wire elements preferably comprise a shape memory alloy, for example a nickel-titanium alloy, wherein upon heating, for example by means of resistance heating, the wire elements in the locking element shrink in length, with the resistance heating being activated via an electronic device.

24. Locking element according to claim 1, wherein an electronic device is provided in the locking element and is operated via a separate operating unit, or is provided in the operating unit and can operate the actuator of the locking element if the operating unit is coupled to the locking element.

25. Locking element according to claim 24, wherein data and/or energy can be transferred between the operating unit and the locking element, wherein the data exchange can be both via wire and wireless.

26. Locking element according to claim 25, wherein a wireless coupling between the locking element and the operating unit can be effected via radio, in particular via inductive coupling, in the very low frequency, low frequency, medium frequency and/or high frequency band, for example in a range of 3 kHz to 30 Mhz.

27. Locking element according to claim 25, wherein a wireless coupling between the locking element and the operating unit can be effected via an optical coupling and/or an electromagnetic coupling, wherein the electromagnetic coupling is preferably effected in the microwave and UHF frequency range for example from 400 MHz to 5 GHz.

28. Locking element according to claim 24, wherein data and/or energy can be transferred between the locking element and the operating unit.

29. Locking element according to claim 28, wherein the electronic device is self-sufficient, i.e. it comprises for example at least one battery, and/or is not self-sufficient or partially self-sufficient, wherein energy is provided via the operating unit for example via a wire or a cable or inductively.

30. Locking element according to claim 24, wherein the operating unit which is coupled to the coupling unit may be detached if an axial force larger than 1 N is applied, preferably larger than 2 N, yet preferably larger than 5 N and more preferably larger than 10 N.

31. Locking element according to claim 24, wherein the operating unit comprises a separate data bus, for example a 1-wire data bus, which is connected to the electronic device of the locking element when the operating unit and the locking element are coupled.

32. Locking element according to claim 1, wherein the electronic device, which is preferably a subminiature electronic device, carries out an authorization examination and/or unlocks the actuator and wherein the authorization examination is for example effected via a PIN code or biometric data.

33. Locking element according to claim 1, wherein the locking element is mechanically and/or electrically coupled to an operating unit via a coupling unit.

34. Operating unit for the use in a locking element according to claim 1, wherein the operating element comprises a coupling unit for coupling with the locking element.

35. Operating unit according to claim 34, wherein the operating unit is formed such that it can preferably be coupled with the locking element via a data bus from the outside and/or in a wireless manner and that it can transmit and/or receive data, wherein a wireless coupling between the operating unit and the locking element can be effected via radio in the very low frequency, low frequency, medium frequency and/or high frequency band, for example in a range of 3 kHz to 30 Mhz, and/or an inductive coupling, and/or an optical coupling and/or an electromagnetic coupling, wherein the electromagnetic coupling is preferably effected in the microwave and UHF frequency range for example from 400 MHz to 5 GHz.

36. Operating unit according to claim 34, characterized in that the operating unit can transfer data and/or energy to the locking element.

37. Operating unit according to claim 34, wherein the operating unit is secured by an authentication process which is preferably effected via a PIN code and/or a radio transponder and/or biometric data which are collected by corresponding sensors.

38. Process for locking a locking element, in particular according to claim 1, in a cartridge chamber of a firearm, the process comprising the steps:

inserting the locking element into the cartridge chamber of the firearm from the cartridge chamber side by applying a force to the distal direction, such that the operating element is moved within the sleeve to the direction of the distal end such that the at least one blocking element is in a retracted position, wherein upon reducing the force to the distal direction causes the operating element to move to the proximal direction within the sleeve and urges the blocking elements radially outwardly for blocking the locking element inside the cartridge chamber.

39. Process for unlocking and removing a locking element, in particular according to claim 1, from a cartridge chamber of a firearm, the process comprising the steps:

coupling an operating unit to the locking element, applying a force at the proximal end of the locking element to the distal direction such that the operating element is moved within the sleeve to the direction of the distal end and the at least one blocking element is retracted, temporarily fixing the operating element within the sleeve by means of an actuator such that a relative movement of the operating element back to the proximal direction is prevented, and pulling the locking element from the cartridge chamber.

* * * * *